US008485831B2

(12) United States Patent
Cipolla et al.

(10) Patent No.: US 8,485,831 B2
(45) Date of Patent: Jul. 16, 2013

(54) TALL MEZZANINE CONNECTOR

(75) Inventors: Thomas M. Cipolla, Katonah, NY (US); Todd Takken, Brewster, NY (US); Paul W. Coteus, Yorktown, NY (US)

(73) Assignee: International Business Machines Corporation, Armonk, NY (US)

( * ) Notice: Subject to any disclaimer, the term of this patent is extended or adjusted under 35 U.S.C. 154(b) by 269 days.

(21) Appl. No.: 12/986,132

(22) Filed: Jan. 6, 2011

(65) Prior Publication Data

US 2012/0178273 A1 Jul. 12, 2012

(51) Int. Cl.
*H01R 12/00* (2006.01)

(52) U.S. Cl.
USPC ..... 439/74; 439/607.07

(58) Field of Classification Search
USPC ..... 439/74, 75, 607.07
See application file for complete search history.

(56) References Cited

U.S. PATENT DOCUMENTS 4,881,908 A * 11/1989 Perry et al. ..... 439/161
4,981,438 A * 1/1991 Bekhiet ..... 439/76.1
5,645,434 A * 7/1997 Leung ..... 439/74
5,800,186 A * 9/1998 Ramirez et al. ..... 439/74
6,036,505 A * 3/2000 Zell et al. ..... 439/74
6,053,747 A * 4/2000 Aggus et al. ..... 439/67
6,171,115 B1 * 1/2001 Mickievicz et al. ..... 439/76.1
6,338,331 B1 * 1/2002 Watanabe et al. ..... 123/399
6,341,966 B1 * 1/2002 Takada et al. ..... 439/108
6,345,989 B1 * 2/2002 Mason et al. ..... 439/74
6,447,310 B1 * 9/2002 Brown ..... 439/108
6,477,059 B1 * 11/2002 Ono et al. ..... 361/785
6,561,821 B1 * 5/2003 Yu ..... 439/74
6,695,622 B2 * 2/2004 Korsunsky et al. ..... 439/65
6,814,620 B1 * 11/2004 Wu ..... 439/607.08
6,840,810 B2 * 1/2005 Brunker et al. ..... 439/637
6,863,542 B2 * 3/2005 Miyashita ..... 439/74
6,893,285 B1 * 5/2005 Chiang ..... 439/378
7,338,291 B2 * 3/2008 Takada ..... 439/65
7,351,106 B2 * 4/2008 Zhu et al. ..... 439/607.27
7,390,194 B1 * 6/2008 Crippen et al. ..... 439/65
7,407,387 B2 8/2008 Johnescu et al.
7,420,819 B2 9/2008 Yang et al.
7,425,137 B1 9/2008 Sipe et al.
7,429,176 B2 9/2008 Johnescu et al.
7,445,467 B1 * 11/2008 Matsuo ..... 439/74
7,713,088 B2 * 5/2010 Sercu et al. ..... 439/607.1
7,740,488 B2 * 6/2010 Taylor ..... 439/66
7,746,654 B2 6/2010 Franz et al.
7,798,852 B2 * 9/2010 Laurx et al. ..... 439/607.08
7,862,376 B2 * 1/2011 Sypolt et al. ..... 439/607.07
7,967,638 B1 * 6/2011 Kline et al. ..... 439/607.07
8,105,114 B2 * 1/2012 Kagotani ..... 439/639
2006/0063400 A1 * 3/2006 Tsai ..... 439/74
2009/0004892 A1 1/2009 Weber
2010/0184307 A1 7/2010 Arai et al.
2012/0295453 A1 * 11/2012 Cipolla et al. ..... 439/67

* cited by examiner

*Primary Examiner* — Neil Abrams
(74) *Attorney, Agent, or Firm* — Thomas A. Beck; Daniel P. Morris

(57) ABSTRACT

A tall mezzanine connector which connects the substantial middle half of each of a pair of circuit cards positioned normal thereto in such a way that there is compliance when the two halves of the circuit cards are not in alignment. The mezzanine connector comprises a header and a receptacle that includes wafers having electrical contact means at each end thereof for contacting contacts in the respective circuit cards, the wafers being held in place by an upper base member and a lower base member.

25 Claims, 36 Drawing Sheets

TALL MEZZANINE CONNECTOR

BACKGROUND OF THE INVENTION

1. Field of the Invention

The invention relates to reliable, separable and dense electrical card-to-card connection technology that is used to make a plurality of electrical connections across the area of large circuit boards. More specifically, the invention relates to a tall, flexible mezzanine connector for parallel-mounted or normal positioned cards.

2. Background of the Invention

The need for chip-to-chip communication bandwidth has tracked the increasing circuit density and computational power of Integrated Circuit (IC) chips. This increased bandwidth has been provided both by increasing the number of chip-to-chip interconnections and by increasing the data rate per interconnection. In computer networks, bandwidth is often used as a synonym for data transfer rate—the amount of data that can be carried from one point to another in a given time period (usually a second). This kind of bandwidth is usually expressed in bits (of data) per second (bps). Occasionally, it's expressed as bytes per second (Bps).

Historically these chip-to-chip interconnections used electrical signaling and were provided at lowest cost by copper lines in printed circuit boards and by electrical card-to-card connectors. A large number of chips on multiple cards would be connected in this fashion.

Attempts made in the art to improve the chip-to-chip interconnections noted above using multiple connections to achieve desired bandwidth and throughput have all had their drawbacks.

United States Patent Publication 20090004892 relates to a board connector module including a frame, accommodating an array of substantially-parallel signal leads (S) and ground leads (G) extending in a longitudinal direction (L). The frame includes edges extending substantially parallel to said leads and one or more transverse bars extending between said edges. The transverse bars of the frame may resist deflection or buckling of these leads and consequently allow for higher stack heights in mezzanine circuit board assemblies U.S. Pat. No. 7,746,654 discloses a computer system is that includes a chassis, a system board coupled to the chassis, and a first connector extending from the system board at a first height and configured to receive a first printed circuit board, wherein the first printed circuit board is configured to be parallel to the system board when received by the first connector, and a second connector extending from the system board at a second height and configured to receive a second printed circuit board, wherein the second printed circuit board is configured to be parallel to the system board when received by the second connector. Other computer systems are provided that include a first mezzanine card and a second mezzanine card or multiple connectors and a plurality of printed circuit boards.

U.S. Pat. No. 7,429,176 discloses a modular board to board mezzanine ball grid array BGA connector includes a plug, a receptacle and if needed an adapter. The plug and the receptacle can be made form the same base pieces to accommodate different stack heights. If a greater stack height is needed, spacers can be used in the plug and the receptacle to accommodate a greater selected stack height. The plug and the receptacle both include a base having interstitial diamond recesses in which the solder balls are disposed and in which one end of a contact is inserted. The plug may further include a plug cover that can be connected to the base, and the receptacle may include a receptacle cover that fits over its base.

U.S. Pat. No. 7,425,137 discloses a connector assembly for connecting first and second circuit boards in a substantially parallel relationship. It includes a first connector mateable to the first circuit board and a second connector mateable to the second circuit board. A third connector is mateable to the first and second connectors and is positioned therebetween. The third connector includes a wafer configured to provide a predetermined spacing between the first and second circuit boards.

U.S. Pat. No. 7,420,819 relates to an expanding high speed transport interface hardware method for motherboard. In the method, a mezzanine card is provided and the mezzanine card has a chip socket. An expanding hardware with high speed transport interface is installed in the chip socket of the mezzanine card. In addition, the mezzanine card is inserted into an idle CPU socket in a motherboard with plural CPU structure to make the mezzanine card electrically connect with the second CPU socket, so that the mezzanine card and the expanding hardware become components of the motherboard. Finally, the motherboard is activated to detect the mezzanine card and the expanding hardware and set the CPU bus as a data transmission path between the mezzanine card and the expanding hardware so as to expand interface hardware for the idle CPU socket.

U.S. Pat. No. 7,407,387 defines a modular board to board mezzanine ball grid array (BGA) connector which includes a plug, a receptacle and if needed an adapter. The plug and the receptacle can be made form the same base pieces to accommodate different stack heights. If a greater stack height is needed, spacers can be used in the plug and the receptacle to accommodate a greater selected stack height. The plug and the receptacle both include a base having interstitial diamond recesses in which the solder balls are disposed and in which one end of a contact is inserted.

U.S. Pat. No. 7,390,194 discloses reduced insertion force mezzanine connector is used to couple first and second circuit boards. In one embodiment a connector frame has a first end disposed against the first circuit board and defining a first wall, and an opposing second end disposed against the second circuit board and defining a second wall generally parallel with the first wall. A plurality of wafers is disposed. Each wafer has a first edge in sliding contact with the first wall and an opposing second edge in sliding contact with the second wall. A plurality of electrically conducting pathways extends along each wafer from the first edge to the second edge. A wafer guide structure defines a plurality of wafer-support aisles on the first and second walls for receiving the edges of the wafers to constrain the wafers with a fixed spacing and generally parallel alignment.

The patented prior art cited above has become less pertinent because, as computers have become faster, i.e., as communications data rates have increased, transmission line impedance discontinuities and frequency-dependent channel loss have limited the maximal electrical transmission distance. The result is that the net lengths of the computer limit the speed at which signals can be transmitted. These electrical signaling constraints have been mitigated, however, by: improved frequency-dependent and noise canceling signaling technology in the chip driver and receiver circuits; improved impedance matching design in the cards and connectors; and by using lower loss materials in the cards and connectors. A more serious limit on the use of electrical chip-to-chip signaling has been the lack of a sufficiently reliable, separable and dense electrical card-to-card connection technology. As a result recent large-scale computing systems have trended towards signaling electrically over the largest possible circuit card, and using dense but expensive optical interconnections between circuit cards. Since optical signaling is expected to remain more expensive than short-distance electrical signaling for quite some years to come, overall system cost would be reduced if dense electrical signaling could be used between circuit cards, thereby reducing the amount of optics in the system.

In the past, circuit cards have been connected to each other by right angle connectors. This arrangement forces the connectors of one circuit card to have its connectors along one particular edge. This limitation forces all signals leaving the card to be carried to another card to connect to this particular edge. Signal nets that start on the edge opposite to the connector edge are forced to travel the full width of the circuit card thus making the net longer than it could be if it left the circuit card in the middle of the card. This longer net length thus limits the frequency at which the signals travel.

An example of an article presently in use in the field of electronics, which has an appearance similar to one embodiment of the present invention, is a standard 90 degree press-fit connector such as is depicted in FIG. 1. A press fit connector actually describes a type of fit for mating parts, usually tighter than, say a sliding fit, and is used inter alia, if the parts do not have to move relative to each other.

An example of a press fit connector has a body 1 and extending therefrom at 90 degree angles are a plurality of connectors of the type indicated at 2 and 3. As is explained later in greater detail, the present invention is a connector comprising flexible wafer assemblies allowing it to be connected to circuit cards that have contacts that are not in straight (vertical) or other alignment with one another. The connector of the present invention embodies a wafer assembly having a printed circuit therein. FIG. 2 is a cutaway view of the interior of the press fit connector depicted in FIG. 1. The metal lines 4 et al. of the press fit connector are a series of parallel metal elements encapsulated in a thermoset or thermoplastic resin and extend in each instance from contact 2 to contact 3. Accordingly, the press fit article formed is rigid and has no electronic circuitry associated with it as is found in the present invention. These prior art articles consist of discrete metal conductors about 0.5 mm thick enclosed in plastic. The thickness of the wafer (the plastic) is on the order of 1.0 mm thick.

The present invention utilizes a flexible printed circuit board where the conductors are "printed" onto a substrate. The conductors are on the order of 0.05 mm thick. The printed circuit cards of the present invention must be terminated in such a way as to be compatible to attaching them to another "system" circuit card. The prior art articles are unsuitable for this application.

The present invention is an improved mezzanine connector which allows signals to leave both cards that are connected together from the middle of either card. The term "mezzanine" describes the stacking of computer component cards in a parallel manner to a single card that then plugs into the computer bus or data path.

Mezzanine connectors are known in the art, and have been used for applications similar to the present invention. The limitation of these existing connectors is their height. The tallest mezzanine connectors presently available are on the order of 50 mm board-to-board. (Tyco Micro-Strip connectors.) This spatial dimension allows limited access to the space between circuit cards for placing other tall components, for example, daughter circuit cards in the space between the main circuit cards. Examples of daughter circuit cards are the VMEbus card, PC card or memory card. These cards extend the functionality of the main or "mother card."

The mezzanine connector of the present invention is an improvement in the art by virtue of its high speed, impedance-controlled signaling while retaining low connector cost; it allows large stack heights, so that multiple major system circuit boards can be stacked with a significant amount of tall electronics, power delivery and cooling on each system circuit board; and has a compliance feature which permits said large stack heights between system circuit boards and permits the system circuit boards themselves to be large in area.

The present invention, inter alia, uses a vertically-oriented printed circuit card or collection of printed circuit cards as the major conducting portion of the mezzanine connector. Vertical here means perpendicular to the plane of the system circuit boards being connected.

Another embodiment included within the scope of the present invention relates to a 90 degree connector which operates in a fashion similar to the vertically oriented circuit card with the exception that the contacts are located 90° from each other rather than the 180° separation found in the vertical card.

For future generations of computers, the ability to place daughter cards on circuit cards with the ability to stack another or several mother/daughter card on the first one is highly desirable in order to minimize the length of signal nets thus maximizing the frequency the circuits can run.

BRIEF SUMMARY OF THE INVENTION

The tall flexible mezzanine connector of the present invention is configured in such a way that there is compliance in the connector that allows it to mate to another half of the connector when the two halves do not align. This compliance allows the connector to be taller, on the order of 100 mm or more, because as distances between boards increase the amount of misalignment increases. A secondary benefit of this invention is that it can be made to be soldered onto surface pads or to be attached to a circuit board by means of a land grid array as opposed to pins pressed into the circuit board. This allows more dense wiring underneath the connector. Another benefit of this invention is, because of the compliance of the connector with respect to the two circuit cards being connected together, more than one connector can be used between two circuit cards and there is no limitation as to the location of one connector with respect to another. This allows a great deal of flexibility in the design of circuits traveling between two circuit cards to minimize signal path lengths and maximize the frequency of signals traveling between the two cards.

More specifically, the present invention is a connector comprising a flexible wafer assembly having means for connecting at least two electronic circuit boards, at any location along the two electronic circuit boards. The connector of wafer assemblies possesses a solid connector substrate having edges defining a shape of the connector substrate and at least one conductive layer in the connector substrate containing signal layers extending from a first edge of the solid substrate to a second edge of the solid substrate; and a return current path ground means for providing a constant impedance and effective shielding between the signal conductors. The flexibility of the connector provides the compliance noted above by allowing the connector to twist or bend in order to connect two distinct circuit cards which are not situated in direct alignment with each other. The wafer assemblies in the connector have built-in flexibility so that the connector can assume a curved or angular shape as discussed in greater detail below.

The connector may assume different forms including vertical conducting lines thereon or a 90 degree wafer card with lines extending from a base radially to a side of said card.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

The preferred embodiment of the present invention will be described below with reference to the accompanying drawings.

The tall mezzanine connector of the present invention inter alia, connects two parallel circuit boards.

More particularly, the wafer connector substrate in the preferred embodiment is a rectangular cuboid since it is a three-dimensional solid, however the wafer connector can assume the shape of any prism configuration depending upon the application to which the wafer connector is to be put.

In describing the present invention, the term "connector" as used herein encompasses a header and a receptacle. The "header" is comprised of a header-base and a plurality of pin assemblies. The "receptacle" is comprised of a receptacle bottom-base, a plurality of wafer assemblies and a top base. The expression "wafer assembly" comprises a wafer circuit card, an upper contact finger assembly and a lower contact finger assembly. Further, as used herein, "wafer circuit card fingers" refers to fingers that contact the printed circuit card, "receptacle contact fingers" refers to fingers that contact the receptacle pins and "metal contact" refers to fingers that attach to either mother card connected to the mezzanine connector. "Circuit card" refers to the wafer assembly minus the two finger assemblies.

In a preferred embodiment, the flexible rectangular cuboid has a front surface and a rear surface, and has edges comprise a top edge and a bottom edge, and side edges connecting said top edge to said bottom edge. Wafer circuit cards having any of the prism configurations will have a plurality of edges.

Figure 1:
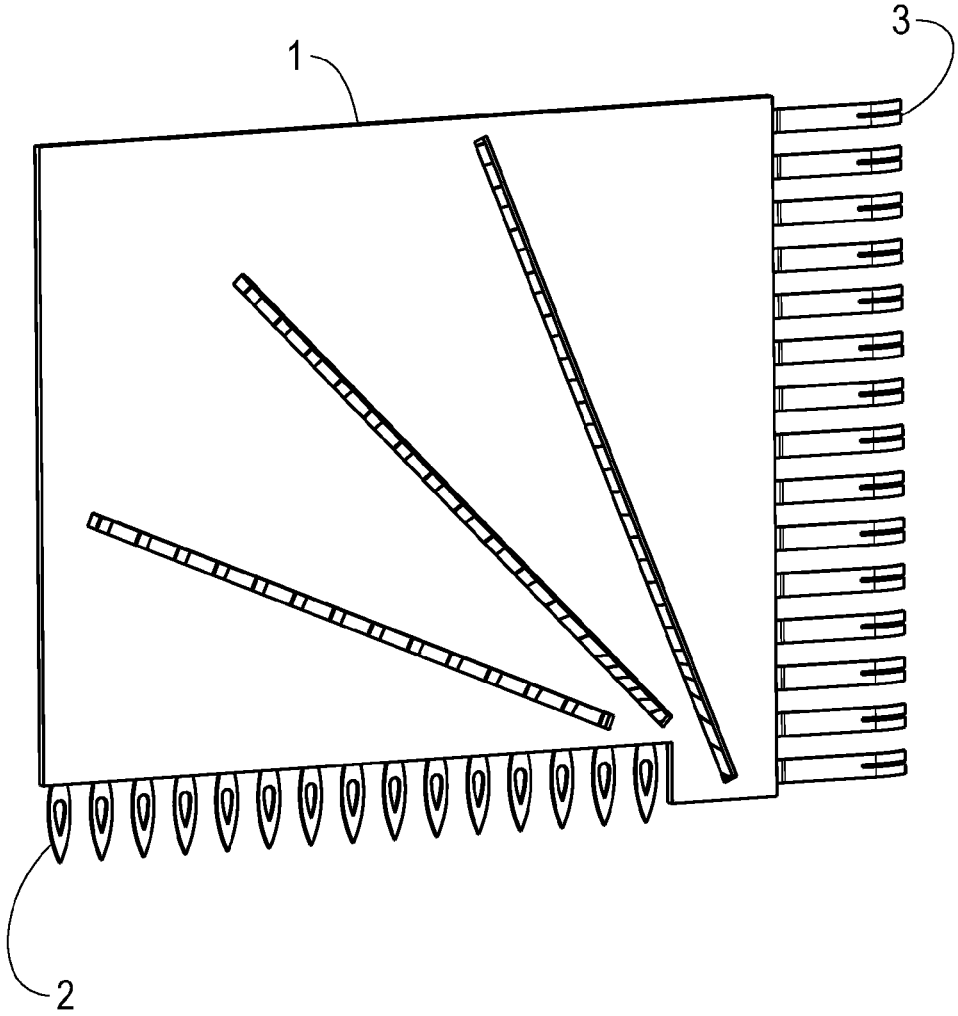
FIG. 1 Prior Art
FIG. 1 is a view of the prior art 90 degree press-fit connector.
Figure 2:
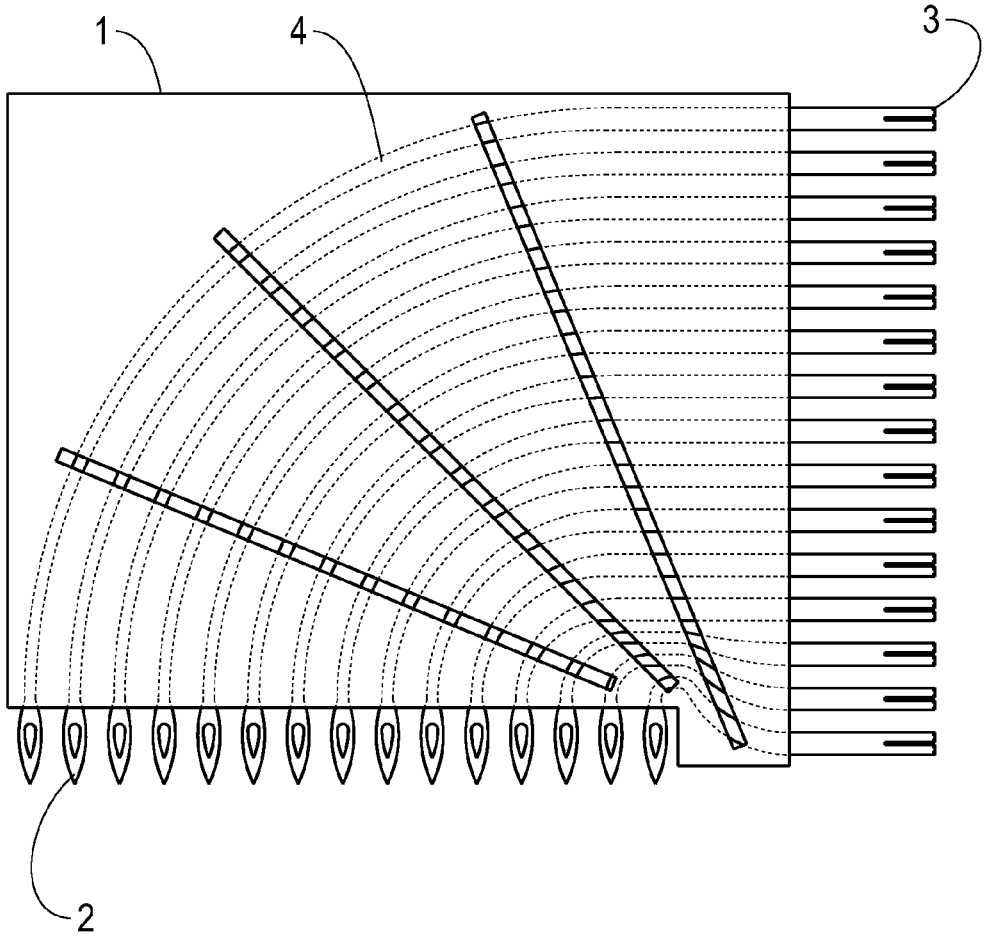
FIG. 2 Prior Art
FIG. 2 is a cutaway view of the prior art 90 degree press-fit connector.
Figure 3:
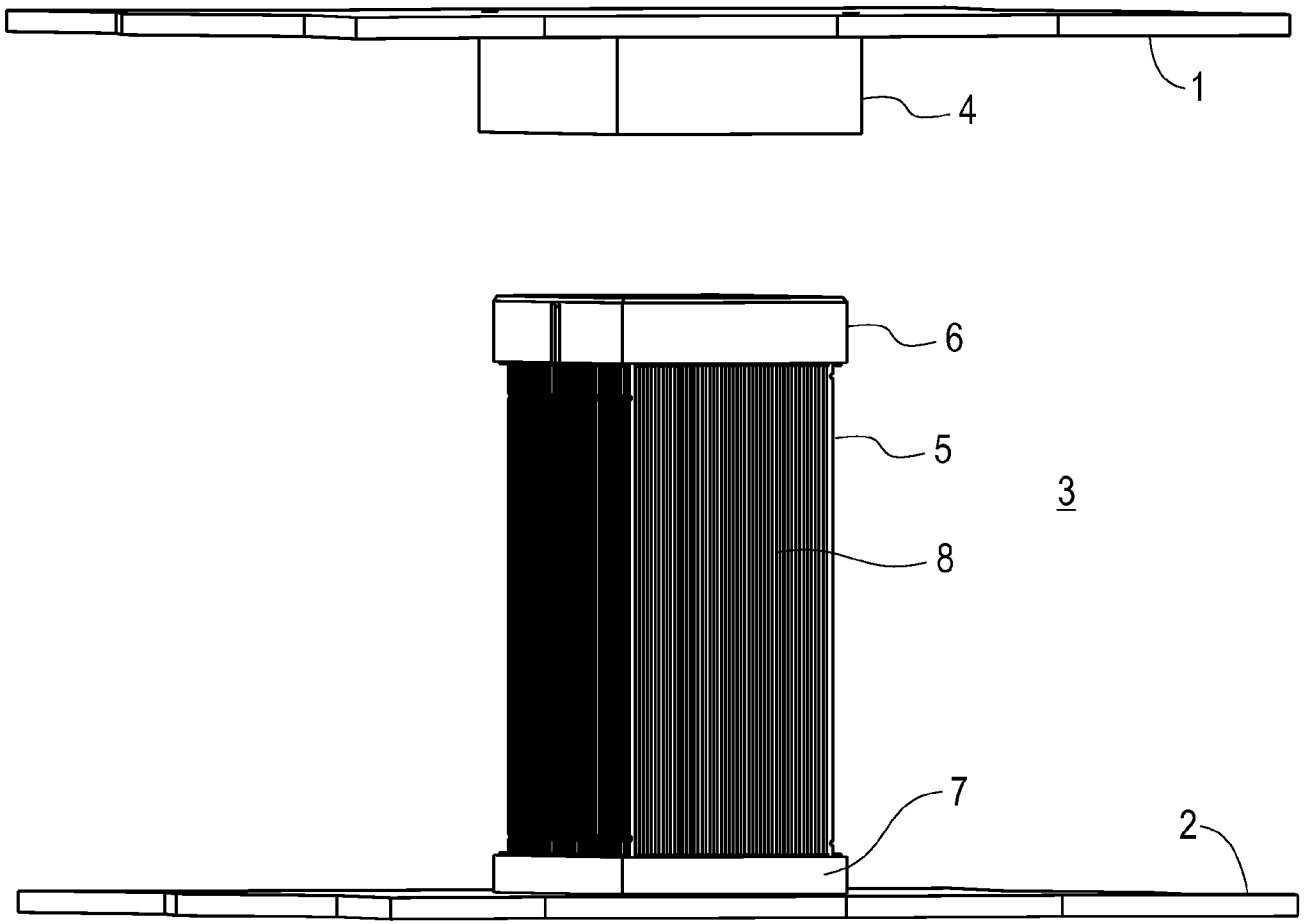
FIG. 3 is an exploded view of the elements comprising the system of the present invention.

FIG. 3 illustrates circuit card 1 and circuit card 2 which are in parallel planes to each other and a connector 3 comprising a header assembly 4 and a receptacle assembly 5 positioned normal to said cards 1 and 2. FIG. 3 depicts an exploded version of connector 3 to illustrate the relationship of the various components with respect to one another. Receptacle assembly 3 components comprise a top-base 6, a bottom-base 7, and a plurality of wafer assemblies 8. Header assembly 4 components comprise a header-base and a plurality of pin assemblies (not shown here but depicted in detail in FIGS. 24A and 24B).

Figure 4:
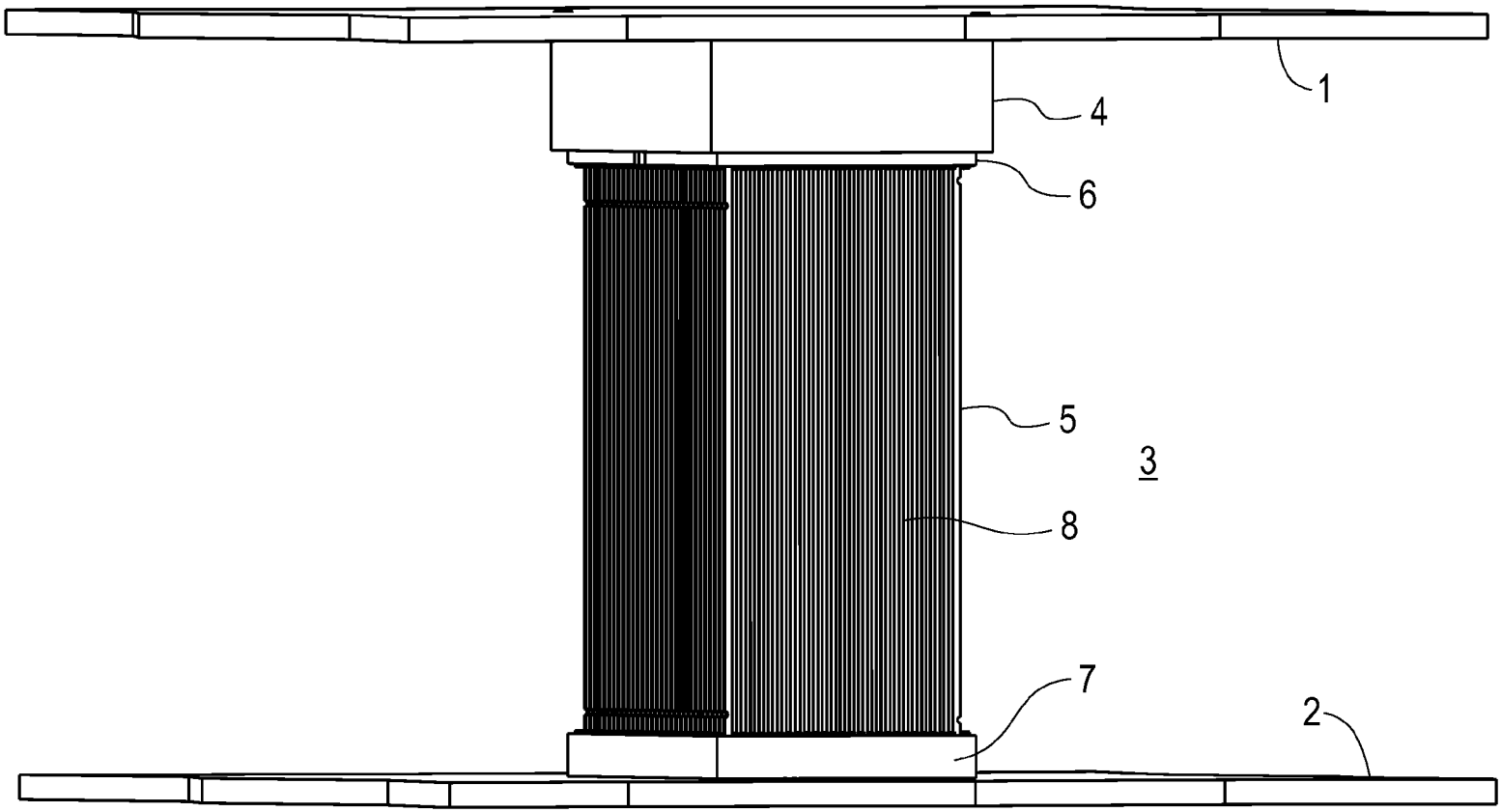
FIG. 4 is a view of the elements comprising the system of the present invention as depicted in FIG. 1 in operating mode.

FIG. 4 depicts the assembled component elements of the connector as described above and depicted in FIG. 3, which is the preferred embodiment of the present invention, including top base 6, a bottom base 7, a plurality of wafer assemblies 8, and header 4.

Figure 5:
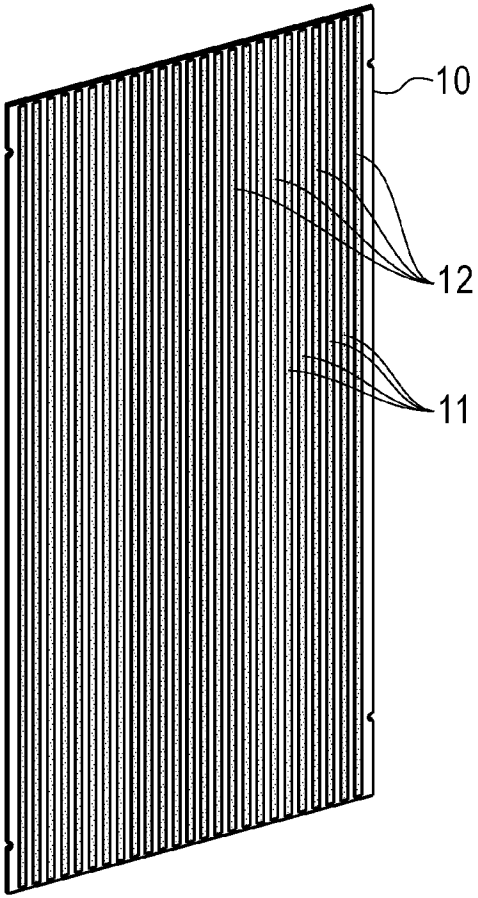
FIG. 5 is a view of the front of a wafer circuit card.

FIG. 5 is a front view of a connector wafer circuit card 10. In the preferred embodiment depicted, connector wafer circuit card 10 is a cuboid, i.e., rectangular in shape but, as noted above, other spatial arrangements or configurations, depending upon the desired application can be used.

Connector wafer circuit card 10 has a thickness of between about 0.5 mm and 0.1 mm, preferably 0.3 mm. The thickness and the material from which card 10 is constructed allow wafer circuit card 10 to be pliable as opposed to rigid, so that it can be used to connect contacts which are not in vertical or other plane alignment with each other. This is one of the critically important features in the present invention. The pliability of the wafer permits "compliance" with respect to large stack heights between system circuit boards and it permits the circuit boards themselves to be large in area. Using a three dimensional Cartesian coordinate with the Z axis representing the vertical axis, the compliance feature allows the wafer to flex along the "Y" axis, i.e., side to side, left to right, and along the "X" axis, i.e., front to back, and positions in-between when the connector wafer contacts positioned at each terminal end thereof to contact points on the two system circuit cards.

A connector wafer circuit card used in the present invention is a printed circuit board fabricated from material such as FR4 with copper lines applied thereto. This connector wafer circuit card serves as a substrate for microfabrication process steps such as etching, deposition of various materials, and photolithographic patterning.

Figure 37:
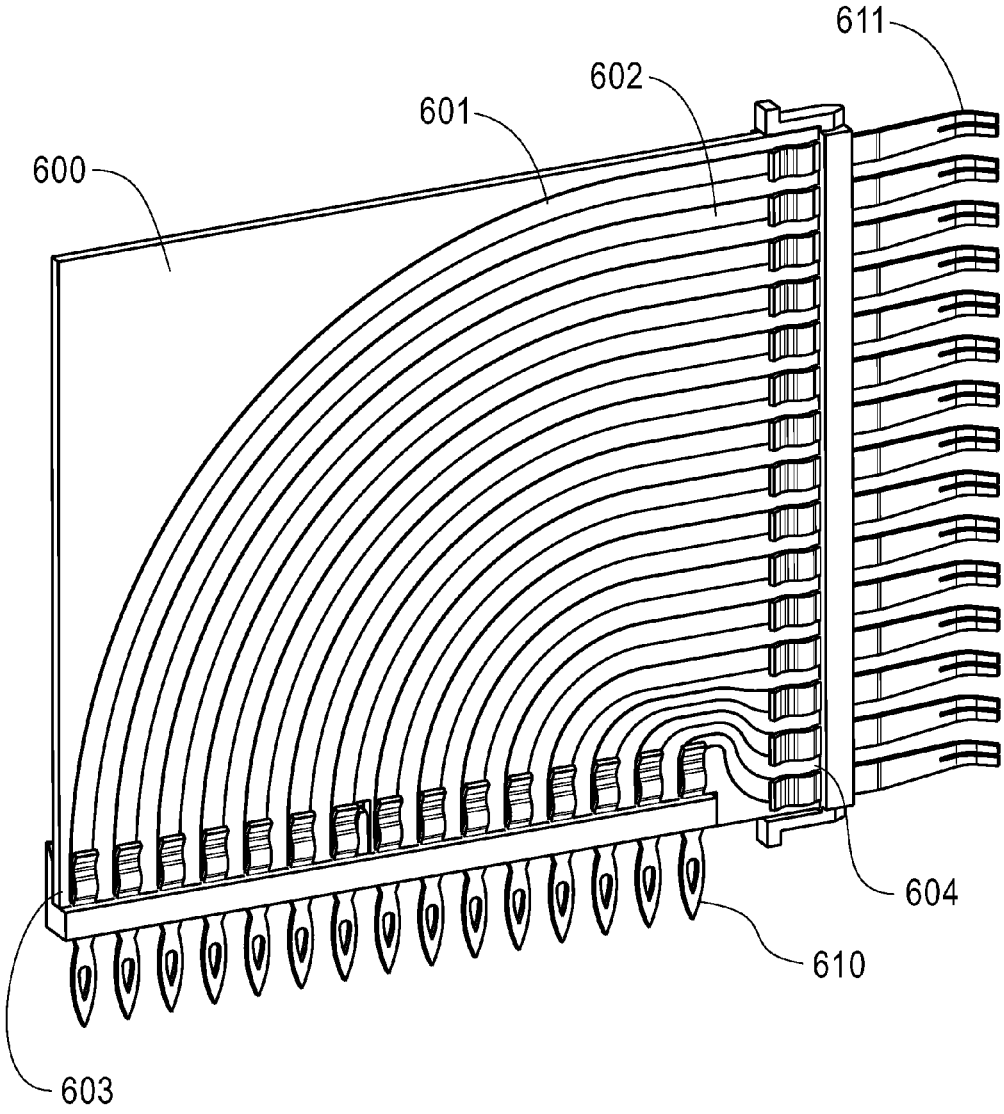
FIG. 37 is an oblique front view of the wafer assembly comprising a wafer circuit card and finger assemblies.

Wafer circuit card 10 depicted in FIG. 5 contains signal pairs 11 alternating with ground lines 12. (FIG. 37, depicts ground lines alternating with signal lines). These lines connect the circuit cards through contact means (not shown).

Figure 6A:
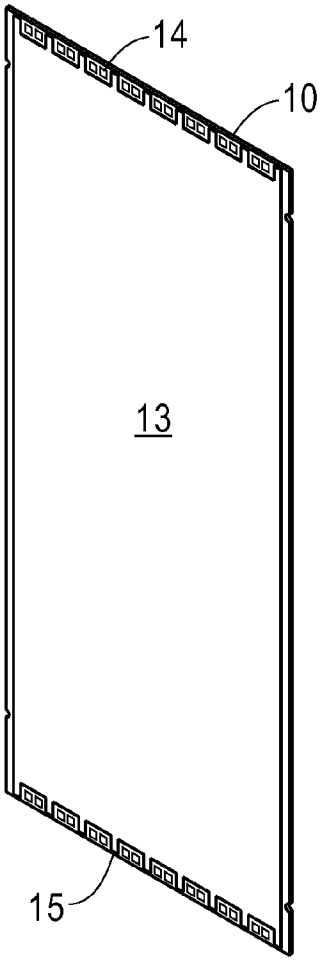
FIG. 6 is a view of the back of the wafer circuit card depicted in FIG. 3.
Figure 6:
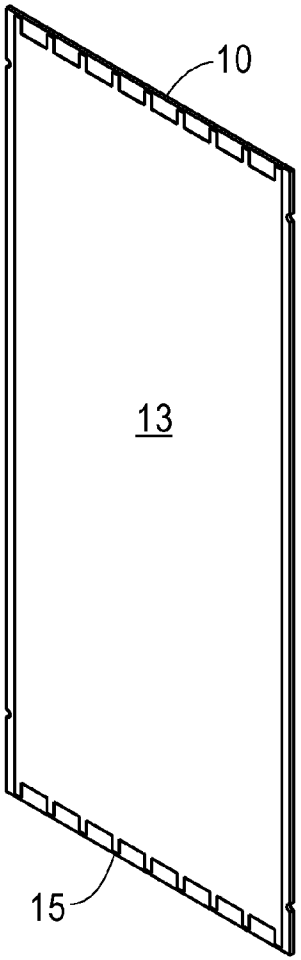

FIG. 6 is a back view of wafer circuit card 10 illustrated in FIG. 5. This view shows a ground plane 13 connected to the front ground lines by vias (not shown). The series of contacts 14, 15 that are aligned along the upper and lower edges of wafer circuit card 10 as depicted in FIG. 6A are an optional embodiment and serve to provide contact points for upper and lower receptacle contact finger assemblies, as explained in greater detail hereinafter.

It is emphasized that the invention is not limited to the wafer configuration depicted in FIGS. 5 and 6. The invention thus is not restricted to a wafer connector wherein the outer surfaces have signal and ground lines alternating as depicted in FIG. 5. The invention may have a series of layers in the connector, and thus it may be made up of multiple layers. The connective layers are made using standard circuit board technology. The conductive layers contain signal lines that travel the required distance of the connector.

It is also emphasized that this invention is also not restricted to the pattern of ground and signal lines on a single layer as shown in the drawings.

Another useful embodiment of the invention includes placing signal lines only on a single layer, and sandwich these lines between ground planes.

In addition to the ground lines depicted in FIG. 5, the return current path is also provided by lines interspersed (not necessarily alternating) within the signals on the signal layers, or by planes, meshes or lines in layers containing mostly ground conductors. The overall conductor can be formed as a single circuit board having varied thicknesses. Alternatively, the conductor can be formed of a series of physically separate circuit boards arranged in layers and held together by headers.

Figure 7:
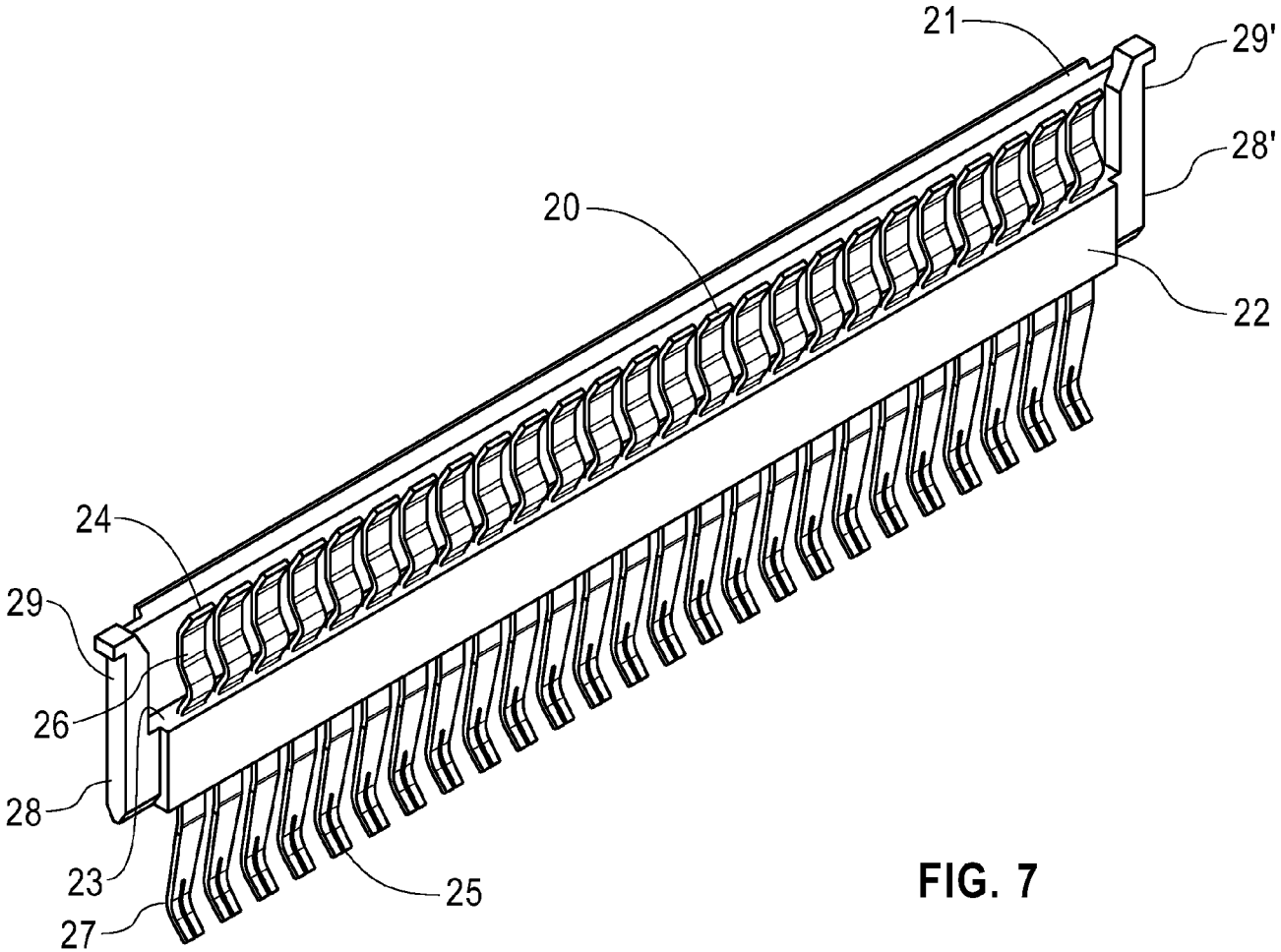
FIG. 7 is a view of the upper receptacle contact finger assembly.
Figure 21:
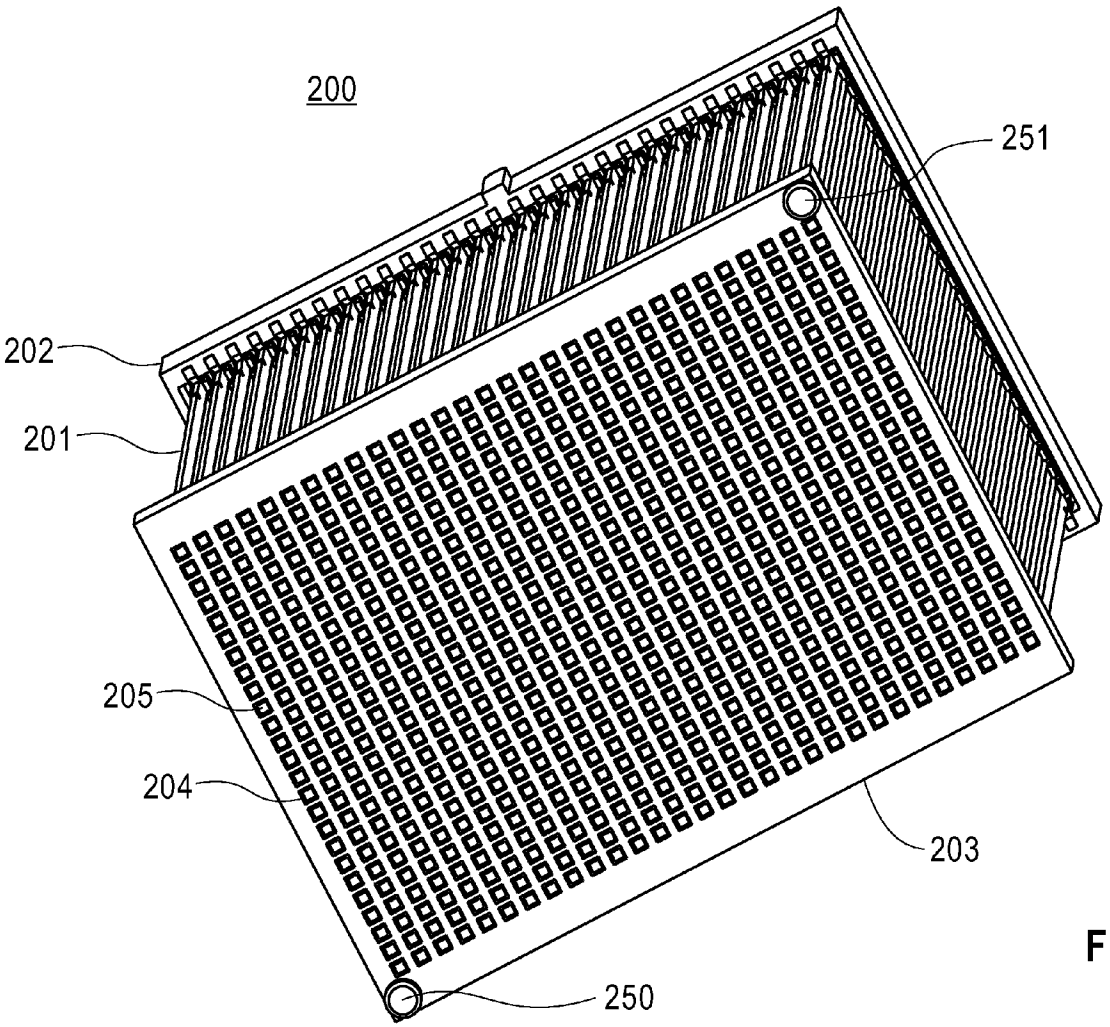
FIG. 21 is a bottom view of the receptacle with the full complement of wafer assemblies installed therein.

FIG. 7 is a view of the upper receptacle contact finger assembly which secures a wafer circuit card to an upper component i.e., the top base (See FIG. 21). The upper receptacle contact finger assembly has wafer circuit card contact fingers 20 in front of vertical molded plastic strip 21. The plastics used in the invention can be of various thermoplastic or thermoset types well known in the art. Support frame 22 has a width substantially identical to the width of vertical molded plastic strip 21. Molded plastic strip 21 and support frame 22 are secured together and form a unitary piece. Support frame 22 has a molded plastic ledge 23, i.e., a solid horizontal projection, forming a narrow shelf extending from said support frame 22 substantially along the front width of support frame 22. Embedded in and extending from ledge 23 forming a front element of support frame 22 is a plurality of fingers. The upper end 24 of said contact finger assembly functions as a wafer circuit card finger contact, and lower end 25 of said contact finger assembly functions as a receptacle contact finger. Each end 24, 25 of the plurality of circuit card contact fingers has a bowed shape 26 or a bent shape 27 designed to make respective contacts with the wafer circuit card positioned adjacent and normal to the base of the receptacle base. Each end 28, 28' of support frame 22 has an appendage 29, 29' that is inserted in the slots provided in the receptacle assembly (See FIG. 21). The appendages 29 and 29' and slots provided in the top base form a bridle joint type of connection when in place.

Figure 8:
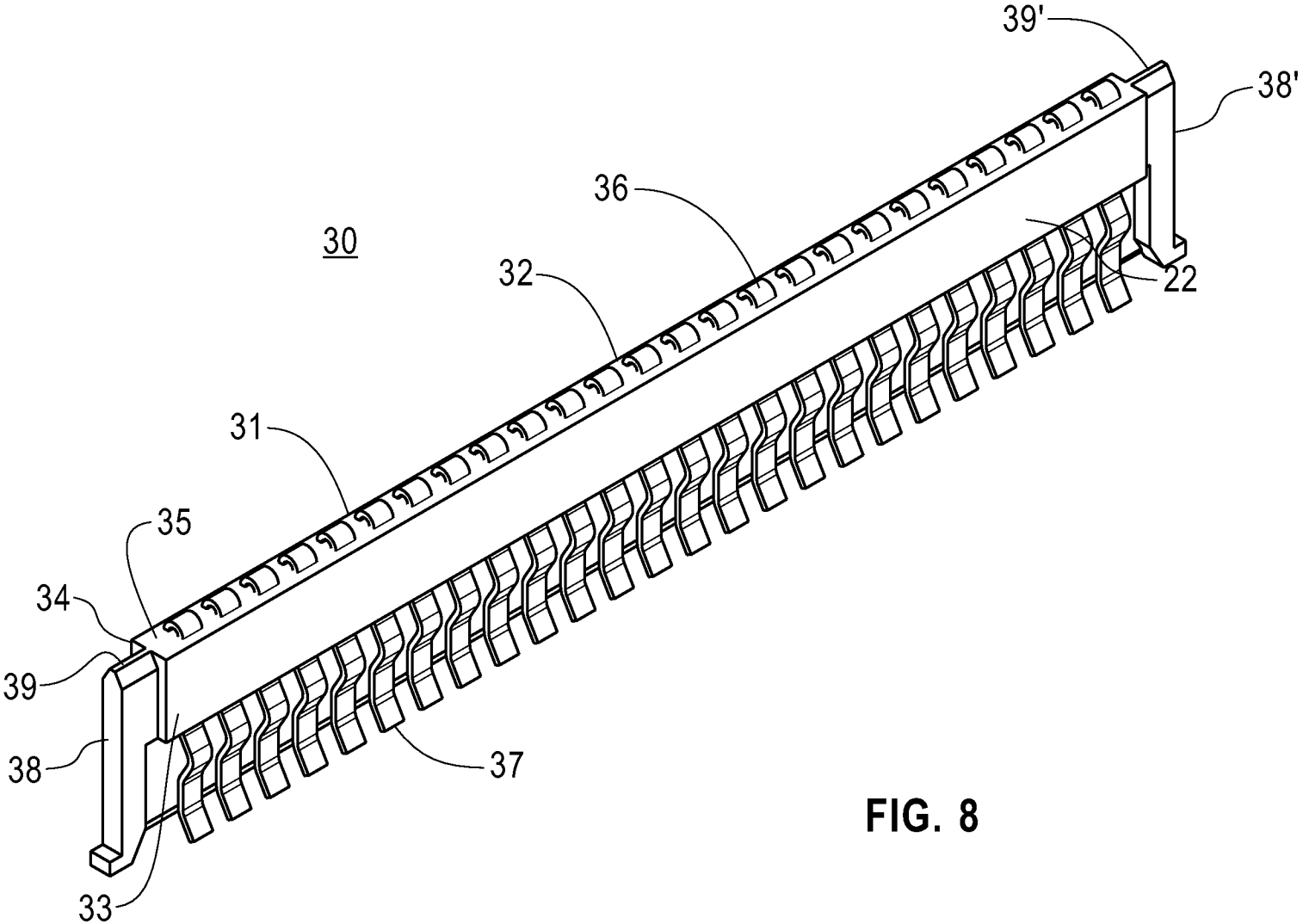
FIG. 8 is a view of the lower receptacle contact finger assembly.
Figure 11:
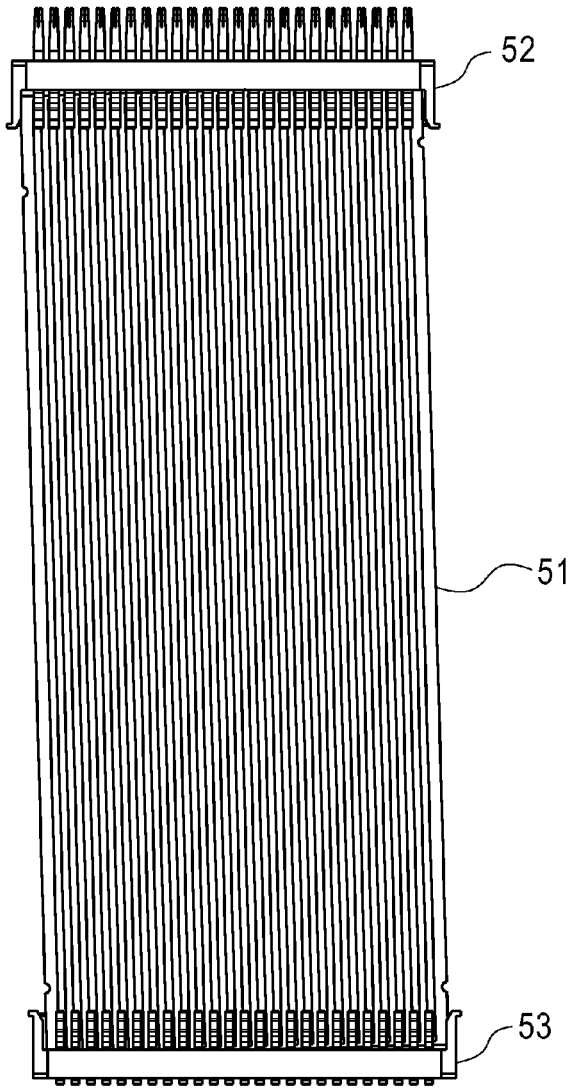
FIG. 11 is a front view of the wafer assembly of the present invention capable of flexing in the event of a left-right misalignment of the contacts in the circuit cards which is connects.

FIG. 8 is a view of the lower receptacle contact finger assembly 30 which secures the wafer circuit card to the base component i.e., the receptacle base not shown (See FIG. 11). The lower receptacle contact finger assembly includes a vertical support frame 31 which has a width substantially identical to the width of the wafer assembly. The top of support frame 31 has a block-like element 32 extending along its width which comprises a solid elongate strip of a molded plastic having two flat sides 33, 34 and a flat top surface 35. Embedded in and extending from support frame 31 is a plurality of lower receptacle contact fingers 36. Extending from the bottom of support frame 31 is a plurality of wafer circuit card contact fingers 37. The exposed sections of receptacle contact fingers 36 and the lower end of finger 37 function as a wafer circuit card finger contact. Each end 38, 38' vertical support frame 31 has an appendage 39, 39' that is inserted in the slots provided in the receptacle assembly (See FIG. 13). The appendages of 39, 39' fit in slots provided in the top base (not shown) form a bridle joint type of connection when in place.

Figure 9:
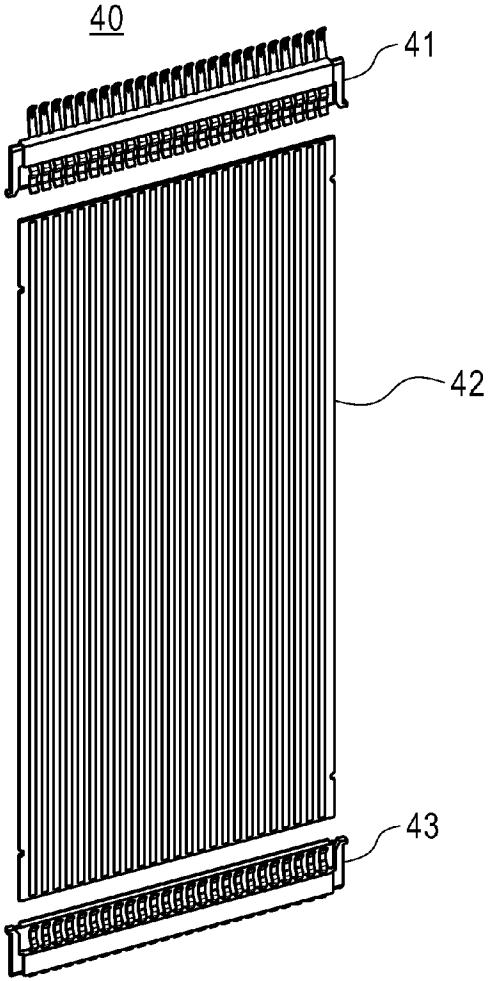
FIG. 9 is an exploded view of the elements comprising the wafer assembly.

FIG. 9 is an exploded view of a single wafer assembly 40 depicting the spatial arrangement of the upper receptacle contact assembly 41, the wafer circuit card 42 and the lower receptacle contact finger assembly 43.

Figure 10:
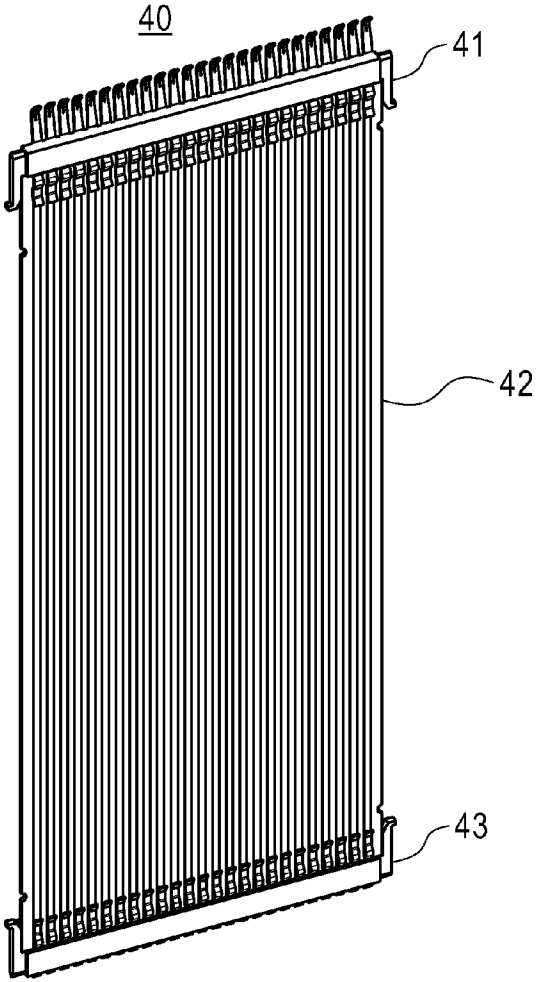
FIG. 10 is a view of the elements comprising the wafer assembly as depicted in FIG. 8 in operating mode.

FIG. 10 depicts an oblique view of the assembled single wafer assembly 40 of FIG. 9, wherein the assembled wafer assembly shows upper receptacle contact assembly 41, connected to wafer circuit card 42, which is turn connected to lower receptacle contact finger assembly 43.

FIG. 11 is a front view of a single wafer assembly as depicted in FIG. 10 illustrating a novel feature of the present invention. Wafer circuit card 51 is capable of pivoting front to back (along the XYZ three dimensional axis) in the both upper 52 and lower 53 contact finger assemblies.

Figure 12:
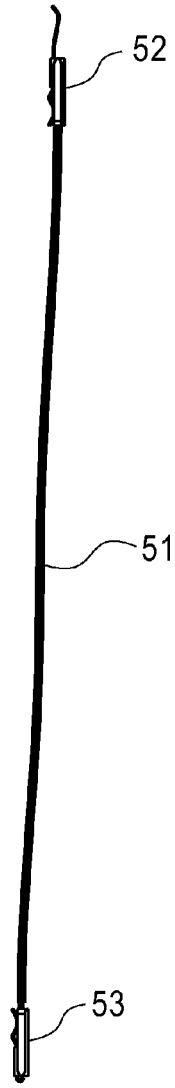
FIG. 12 is a side view of the flexed wafer assembly depicted in FIG. 11.

FIG. 12 is a side view of the single wafer assembly depicted in FIG. 11. This figure further illustrates a novel feature of the present invention showing that wafer circuit card 51 flexes due to the thinness of the card since upper assembly 52 and lower assembly 53 are not in vertical alignment when each is connected to, for example the mid area of parallel circuit cards.

Figure 13:
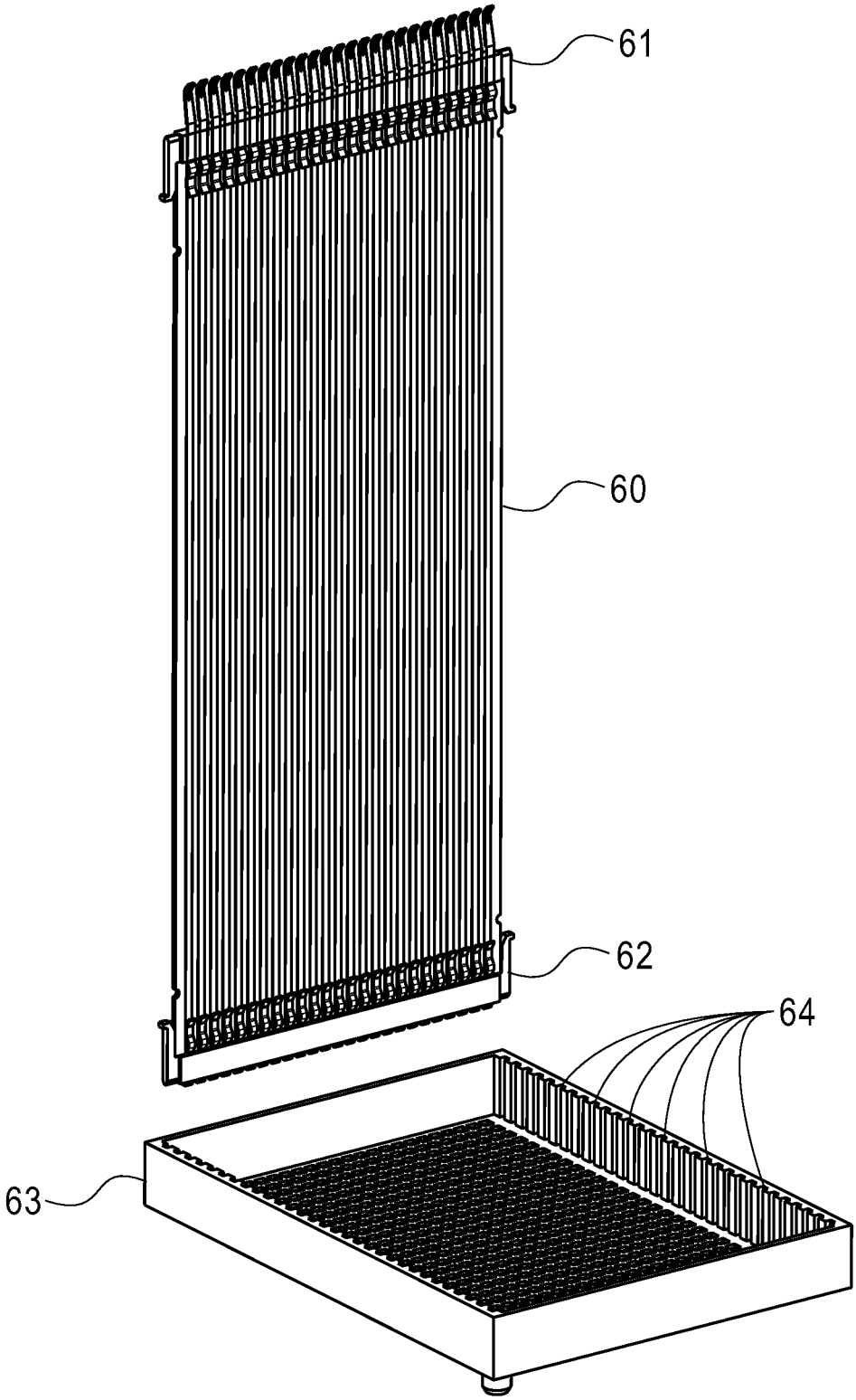
FIG. 13 is an exploded view of the receptacle assembly showing positioning of the receptacle base and one wafer assembly.

FIG. 13 is an exploded oblique view of the wafer assembly 40 depicted in FIG. 10 with wafer circuit card 60, upper contact finger assembly 61 and lower contact finger assembly 62 and a receptacle base 63 having slots 64 adapted to receive and secure appendages 39 and 39' depicted in FIG. 8.

Figure 14:
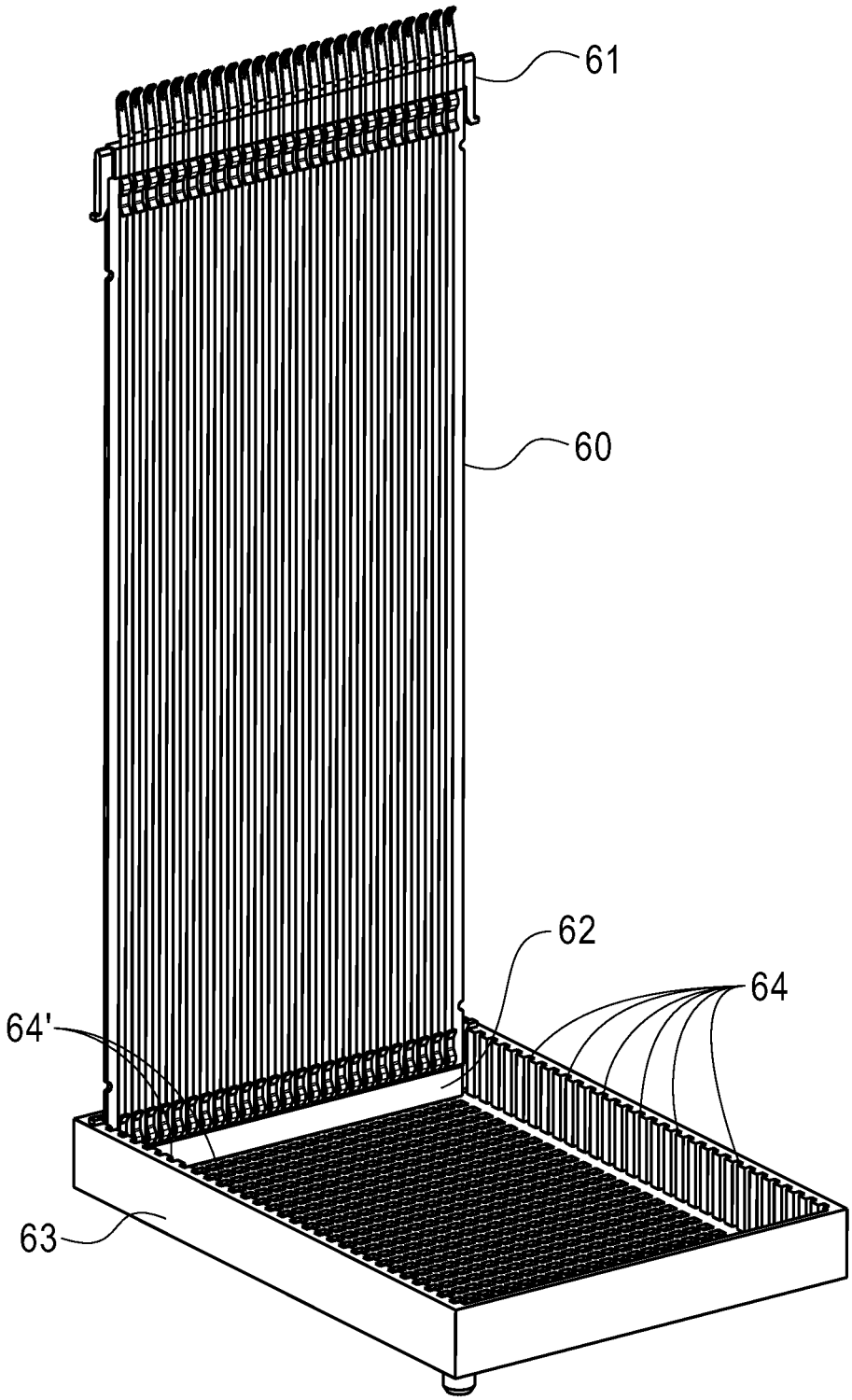
FIG. 14 is a view of the receptacle assembly as depicted in FIG. 13 showing the wafer assembly connected to the receptacle base.

FIG. 14 is an oblique view of the receptacle assembly 63 depicted in FIG. 13 having the elements depicted in FIG. 13, wherein the receptacle contact finger assembly 62 at the bottom of wafer assembly 40 are pushed into and secured in vertical slots 64 and 64' in receptacle base 63, wherein slots 64 and 64' are located in receptacle 63 diametrically across from each other. As with most connectors in the art that use wafers, the wafers are held to the receptacle base by a slight interference fit thereby holding the parts together by friction.

Figure 15:
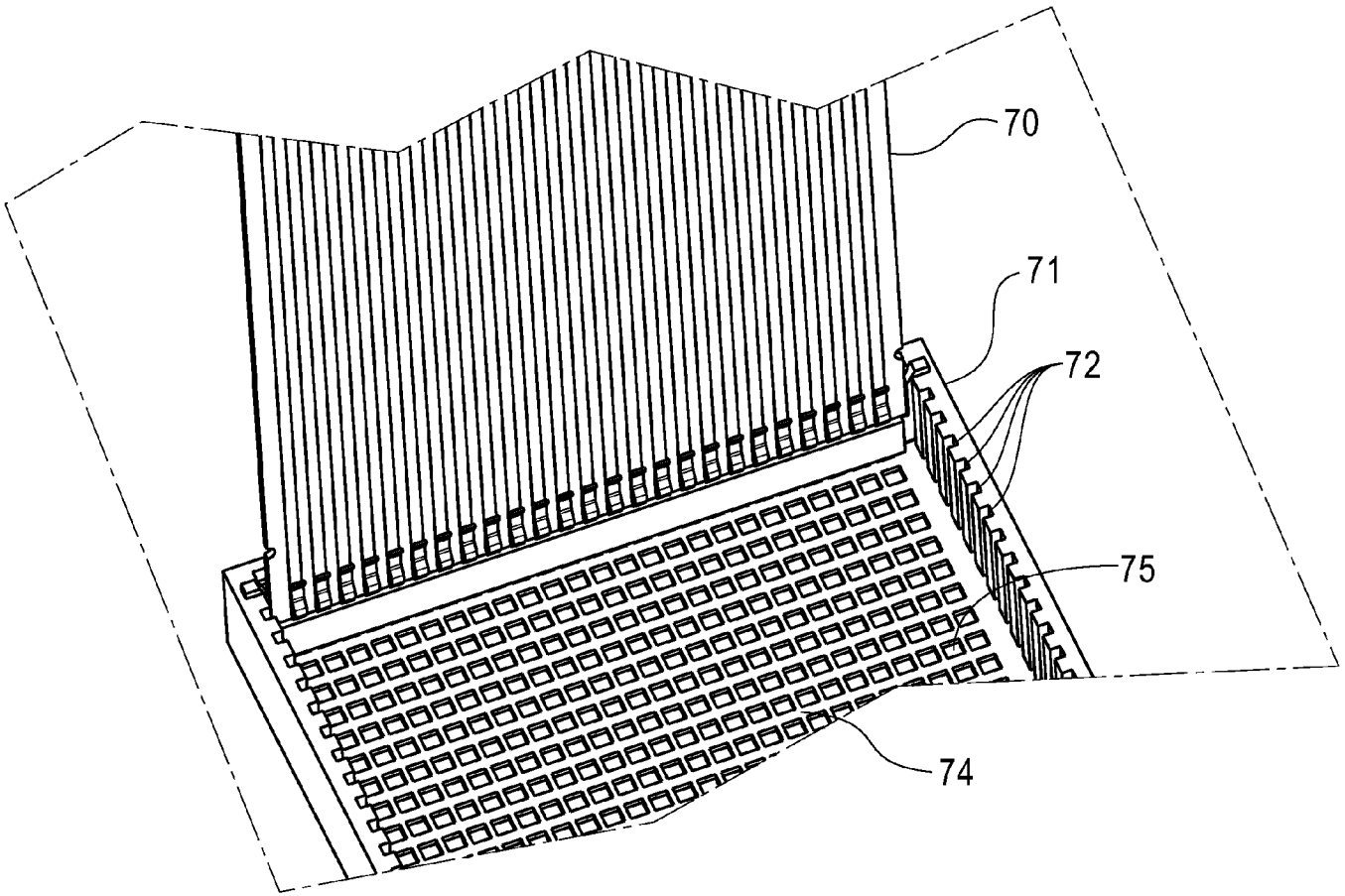
FIG. 15 is a close-up view of a single wafer assembly inserted into the receptacle base.

FIG. 15 is a close-up front view of the single wafer assembly 70 depicted in FIG. 10 inserted into receptacle assembly 71, and is a top view of the upper surface within the base of receptacle 71. Lower receptacle contact finger assembly appendages of the type of appendages 39 and 39' depicted in FIG. 8 are inserted into slots 72 in the interior side of the two parallel walls of receptacle assembly 71, the slots being positioned in-line with each other to secure the bottom of wafer assembly 70 therein. The upper area surface 74 within receptacle base 71 is comprised of parallel rows and columns of openings 75.

Figure 16:
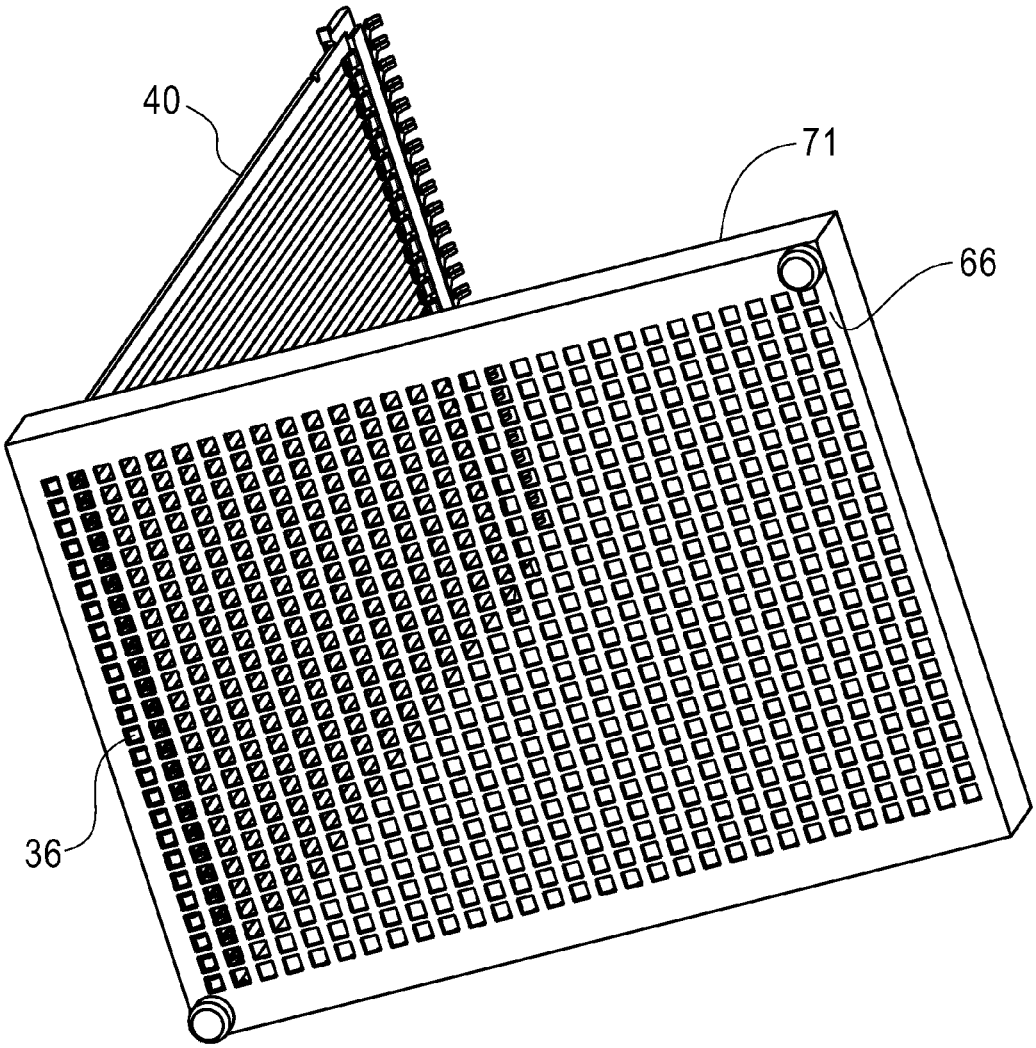
FIG. 16 is a bottom view of the receptacle base showing the contact fingers of a single wafer assembly protruding through the openings in the receptacle base.

FIG. 16 depicts a bottom isometric view of the assembly illustrated in FIG. 14. FIG. 16 shows a single wafer assembly 40 secured in place in receptacle assembly 71. Receptacle contact fingers 36 depicted in FIG. 8 are illustrated protruding slightly through the openings in bottom receptacle base 66.

Figure 17:
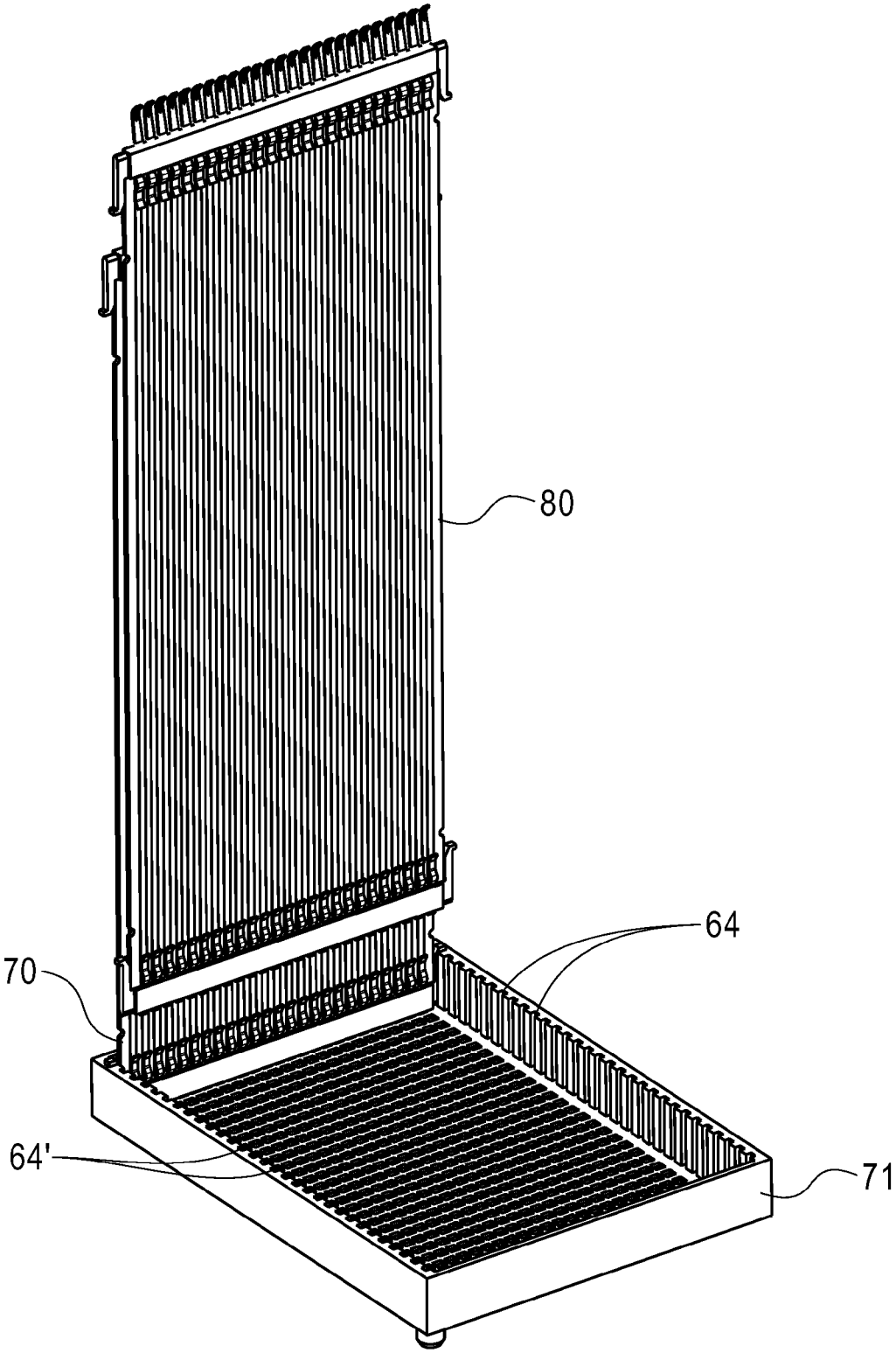
FIG. 17 is a view of two wafer assemblies aligned for insertion into the receptacle base.

FIG. 17 is an exploded view of the receptacle assembly depicted in FIG. 14, wherein each of the elements disclosed in FIG. 14 is in place in the assembly. In addition a second wafer assembly 80, having all of the elements described in the wafer assembly depicted in FIG. 10 included therein, is positioned directly in front of first wafer assembly 70. The second wafer assembly is aligned to be secured within the slots 64, 64' diametrically opposite each other in receptacle base 71.

Figure 18:
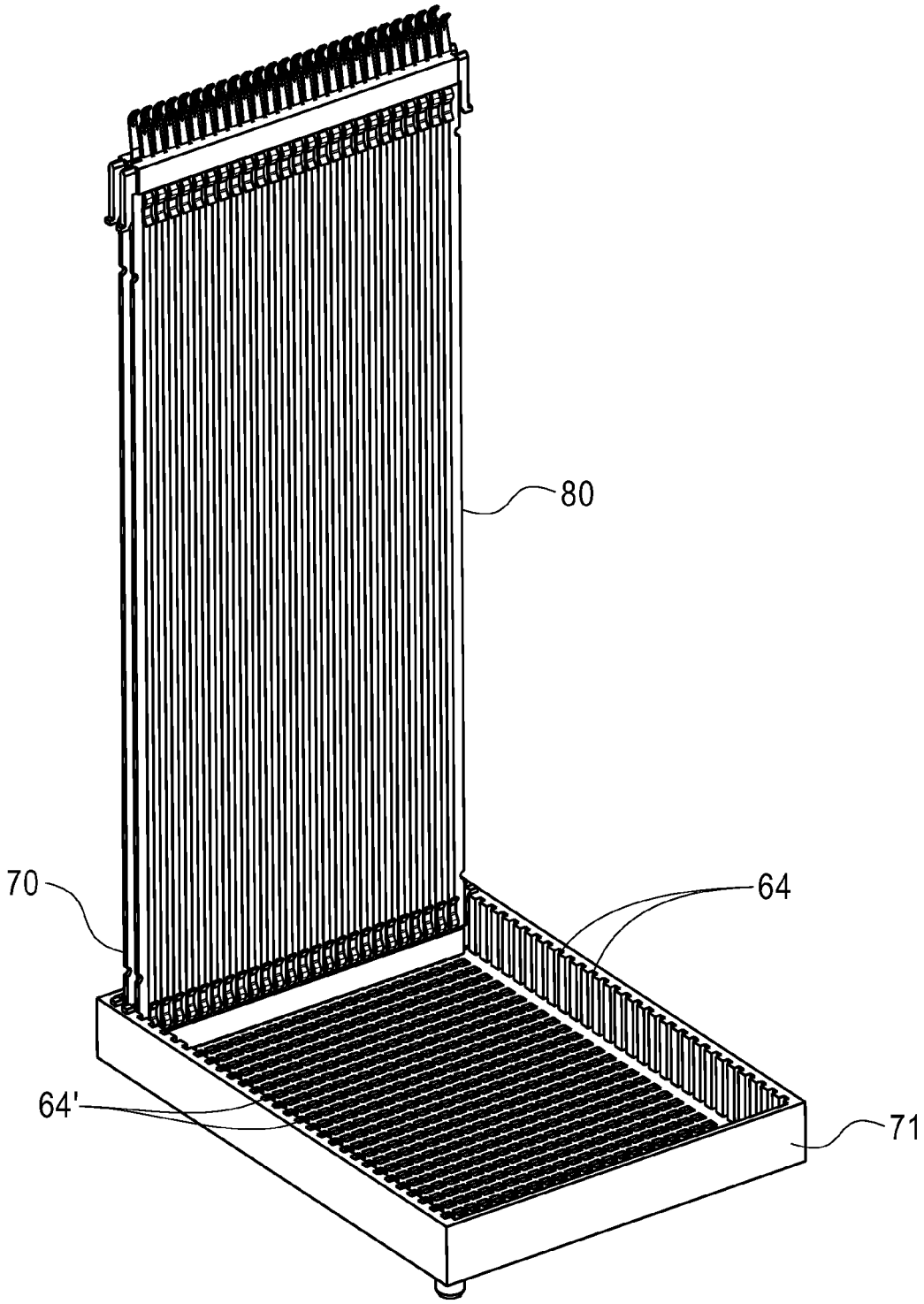
FIG. 18 is a view of the second wafer assembly depicted in FIG. 17 inserted into the receptacle base.

FIG. 18 depicts receptacle assembly 71 wherein second wafer assembly 80, immediately in front of first wafer assembly 70, is pushed into the slots 64, 64' provided for in receptacle base 71.

Figure 19:
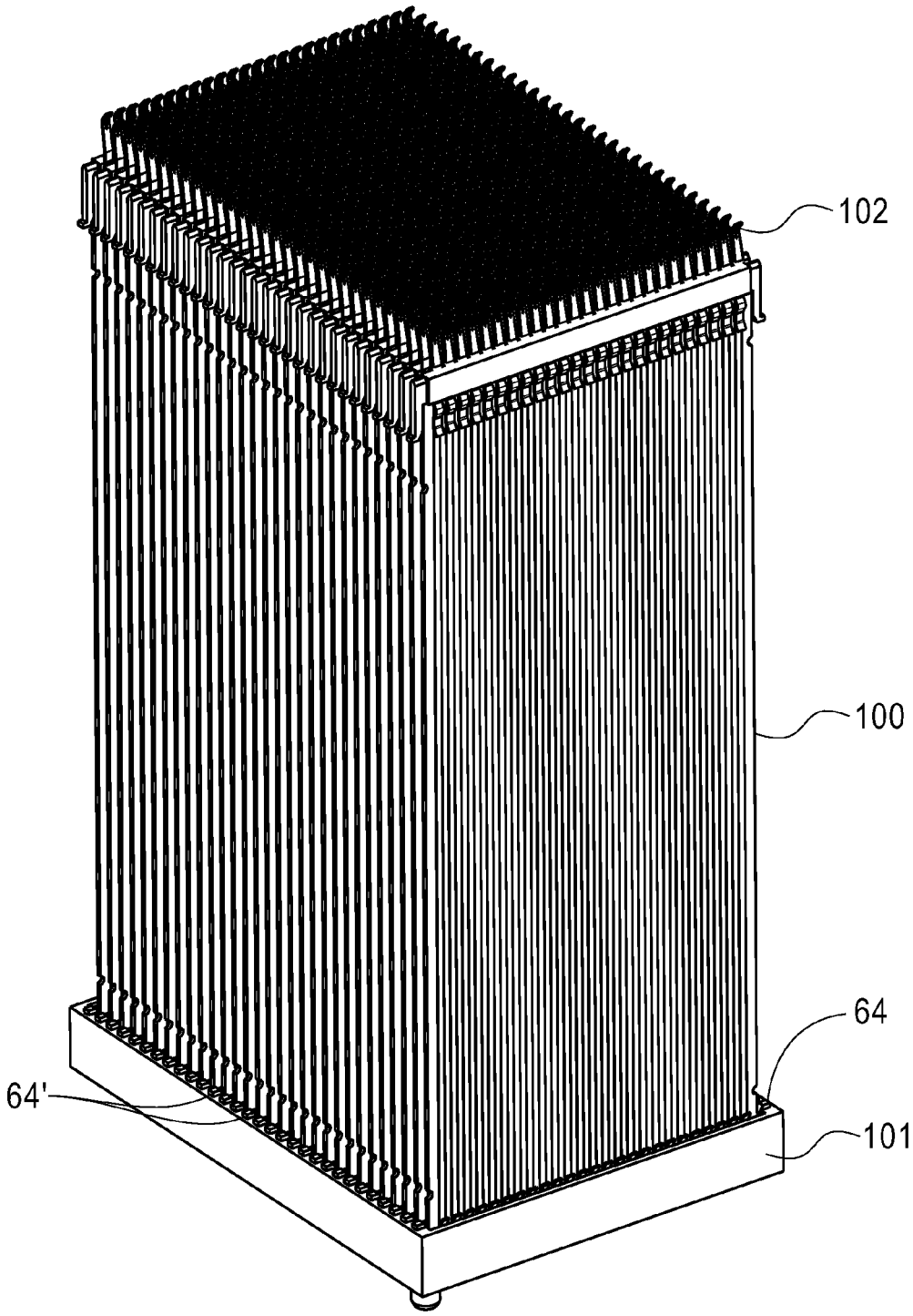
FIG. 19 is a view of the receptacle assembly wherein a full complement of wafer assemblies are installed therein.

FIG. 19 illustrates a receptacle assembly that is fully populated with wafer assemblies 100. In this system, each of slots 64, 64' et al. located in the interior base of receptacle base 101 positioned in alignment diametrically across from each other, contains an appendage (not shown—of the type 39 and 39' of FIG. 8). A plurality of upper receptacle contact finger assemblies 102 are aligned along the top of the assembly, and lower receptacle contact finger assemblies are hidden from view, extend below said wafer assemblies.

Figure 20:
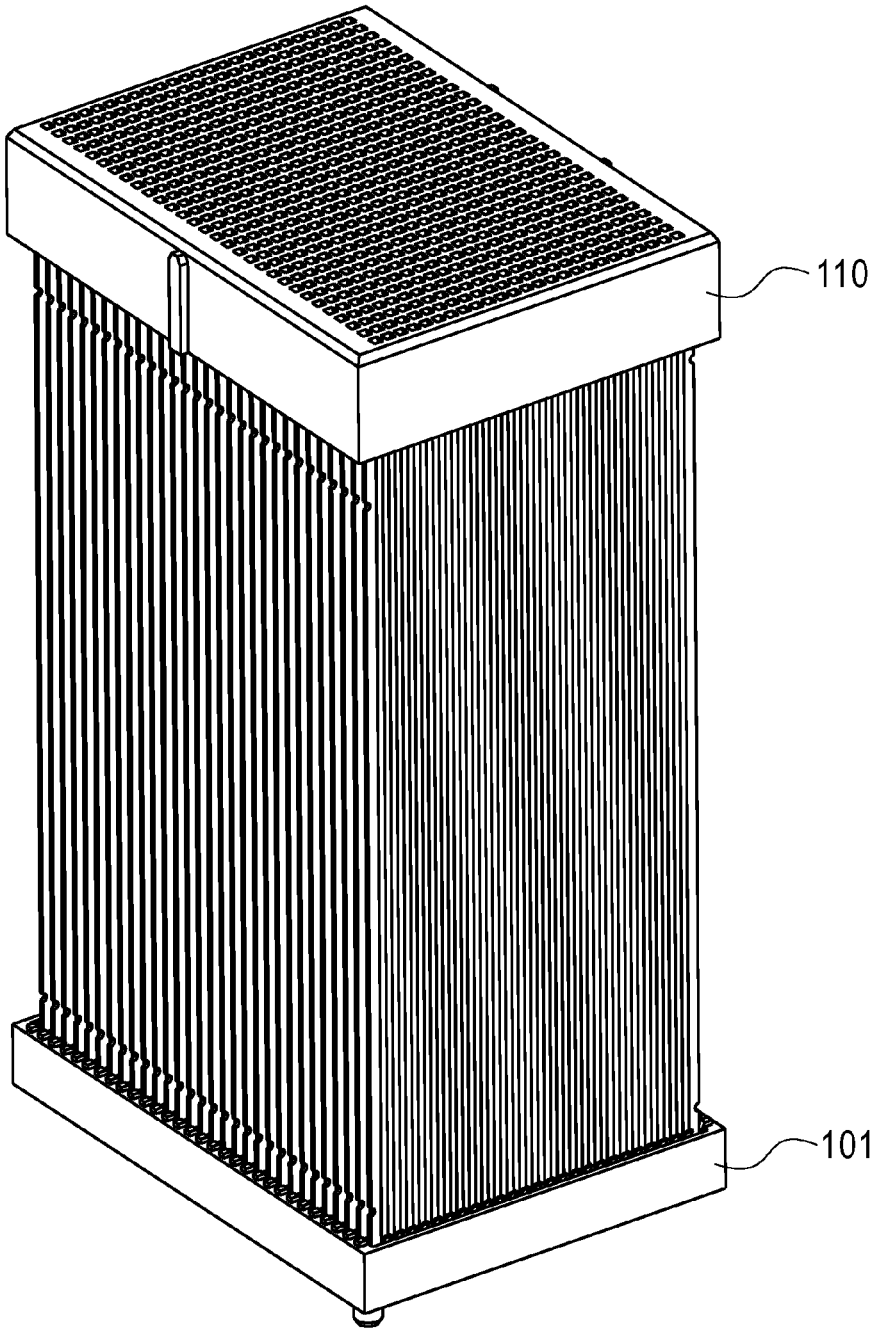
FIG. 20 is a view of the receptacle assembly with the top base installed.

FIG. 20 depicts the receptacle assembly with a top base 110 added completing the receptacle assembly. The structure of top base 110 is similar to receptacle base 101 with openings and slots (both not shown). The balance of the assembly is as described and depicted in FIG. 19.

FIG. 21 is a bottom view of the receptacle assembly 200 showing a plurality of parallel connector wafer circuit cards 201 extending between top base 202 and bottom base 203. The bottom of bottom base 203 has columns and rows of openings as illustrated at 204, and each of the openings 204 in base 203 is filled with receptacle contact fingers 205. Alignment pins 250 and 251 serve to position the tall mezzanine connector unit of the present invention in its proper place on a circuit card (illustrated in FIG. 32).

Figure 22:
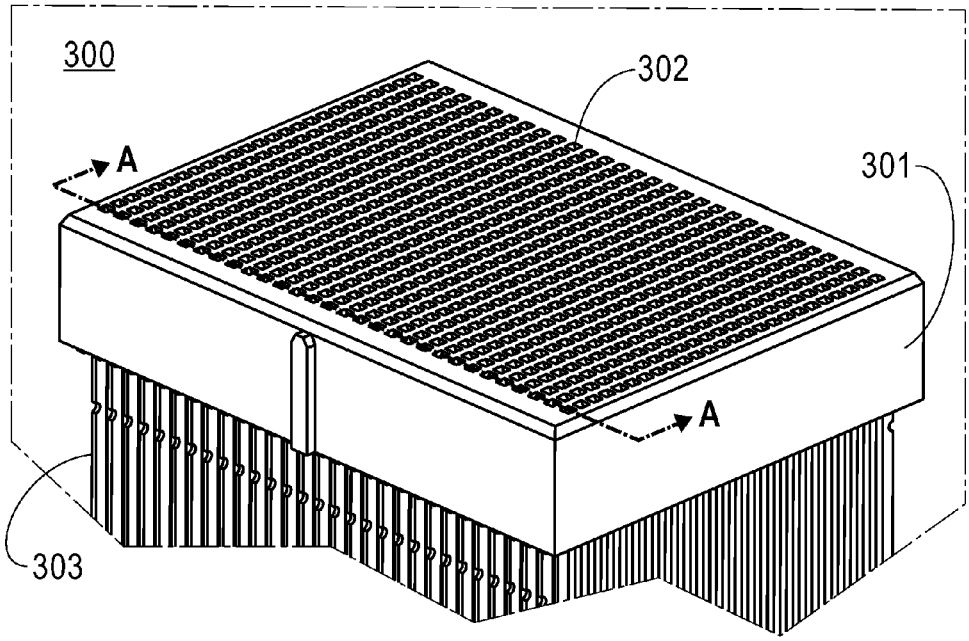
FIG. 22 is a view of the top element of the receptacle assembly.

FIG. 22 provides an isometric view of the top base 301 of receptacle assembly 300 with the plurality of rows and columns of openings of the type illustrated at 302 along with a plurality of connector wafer circuit cards 303 extending downwardly therefrom.

Figure 23:
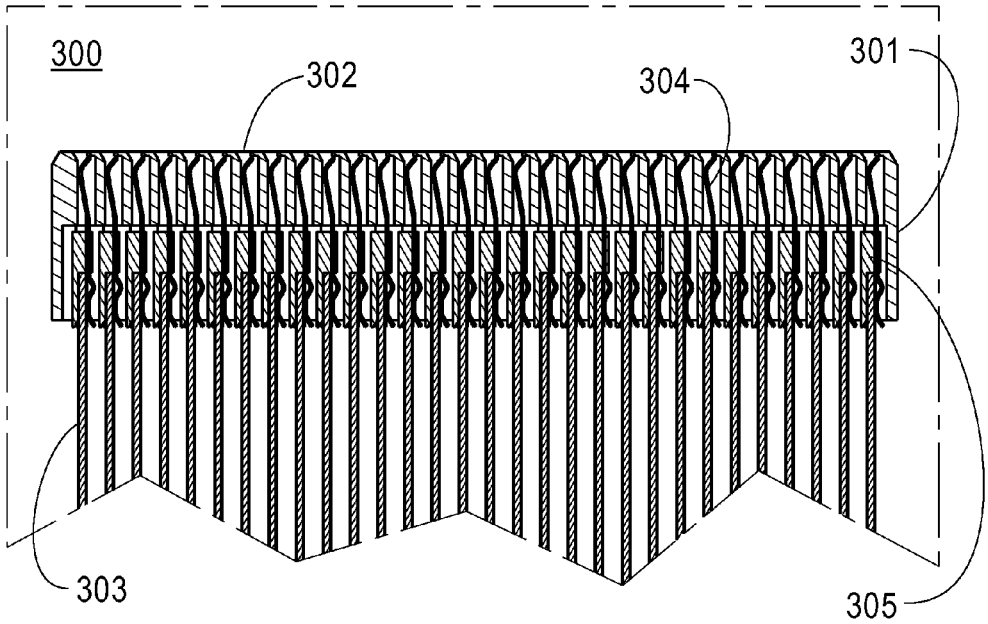
FIG. 23 is a cutaway view of the top element of the receptacle assembly depicted in FIG. 22 along the A-A line.

FIG. 23 is an isometric cutway top view of the receptacle assembly along the line A-A of FIG. 22. The cutaway view depicts receptacle contact fingers 304 along the edge of receptacle assembly 300, the molded plastic ledge 305 and receptacle contact fingers 304. Receptacle contact fingers 304 are situated within openings 302 of receptacle assembly 300.

Figures 24A, 24B:
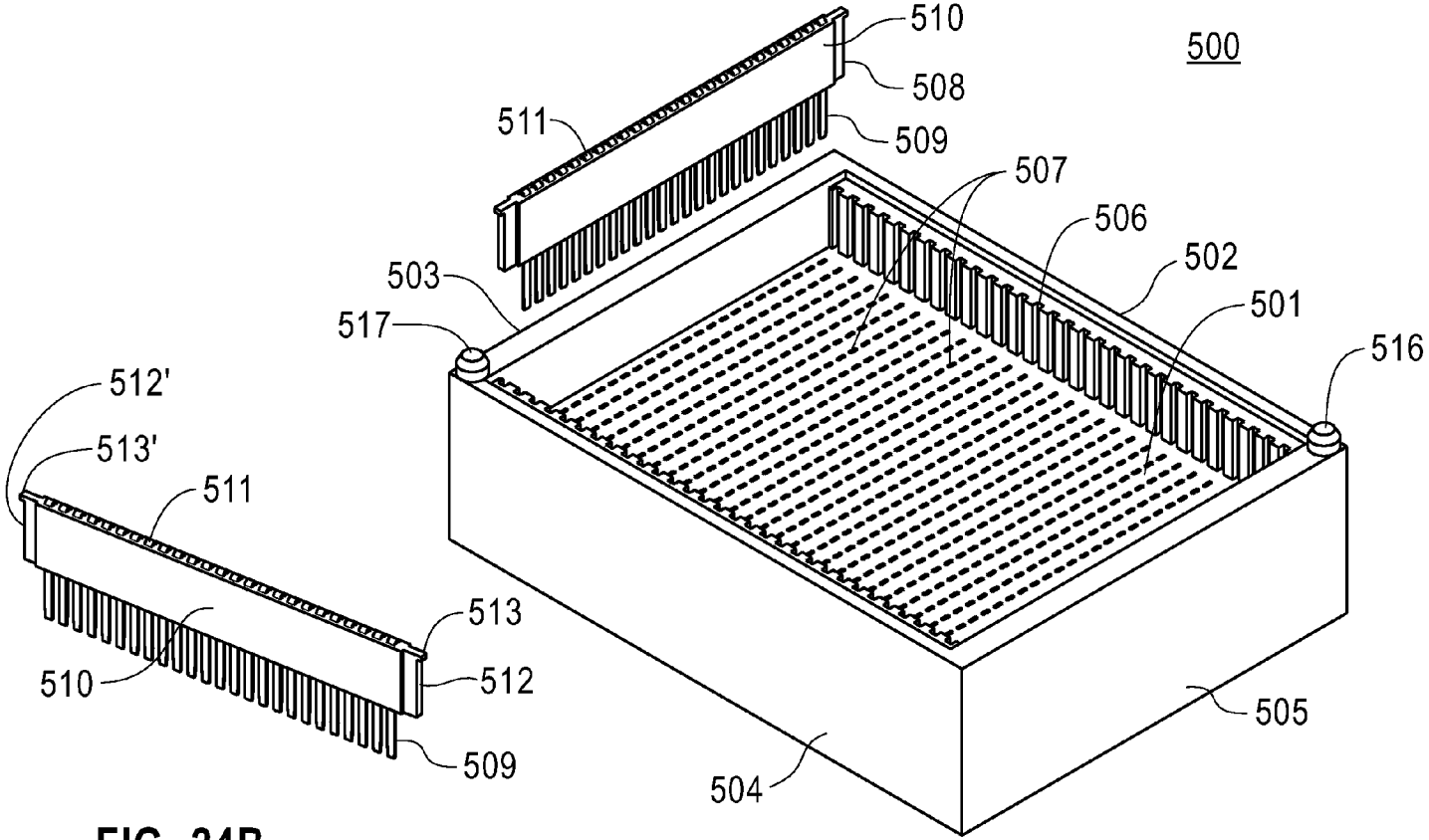
FIG. 24A is a view of the header assembly with pin assembly.
FIG. 24B is a close up view of the pin assembly.

FIG. 24A depicts an exploded view of the header assembly of the present invention which functions in cooperation with the receptacle assembly as described above. Header assembly 500 is a rectangular structure having a base 501 supporting four interconnected sides 502. 503, 504 and 505. The interior of two diametrically opposite sides 502 and 504 contain a plurality of vertically parallel spacer grooves of the type illustrated at 506, with pairs of grooves being positioned diametrically opposite each other. The interior base of the header contains a plurality of openings of the type illustrated at 507 which are in alignment with each of the diametrically opposite grooves. Pin assembly 508 has a plurality of conductors 509 extending from plastic frame 510 which conductors are spaced along the width of the pin assembly to fit within the openings 507 along each row between diametrically opposite spacer grooves as depicted at 506. Metal contacts 511 are situated along the width of plastic frame 510. Metal contacts 511 contact the contact sites in the adjacent circuit card. Alignment pins 516 and 517 are positioned at the top diagonal corners of assembly 500.

FIG. 24B is isometric view of a pin assembly used in conjunction with the header assembly. Fingerlike metallic conductors 509 extend downwardly from a molded plastic support frame 510 along its width. Metal contacts 511 having the shape shown are positioned along the top edge of support frame 510 to contact solder pads, or any other type connection being used in a circuit card when in use. Each end 512 and 512' of support frame 510 has an appendage 513 and 513' that is inserted in the grooves provided in the header assembly shown in FIG. 24A at 506. The appendages of 513 and 513' and grooves (506) provided in the header assembly 500 form a bridle joint type of connection when in place.

Figure 25:
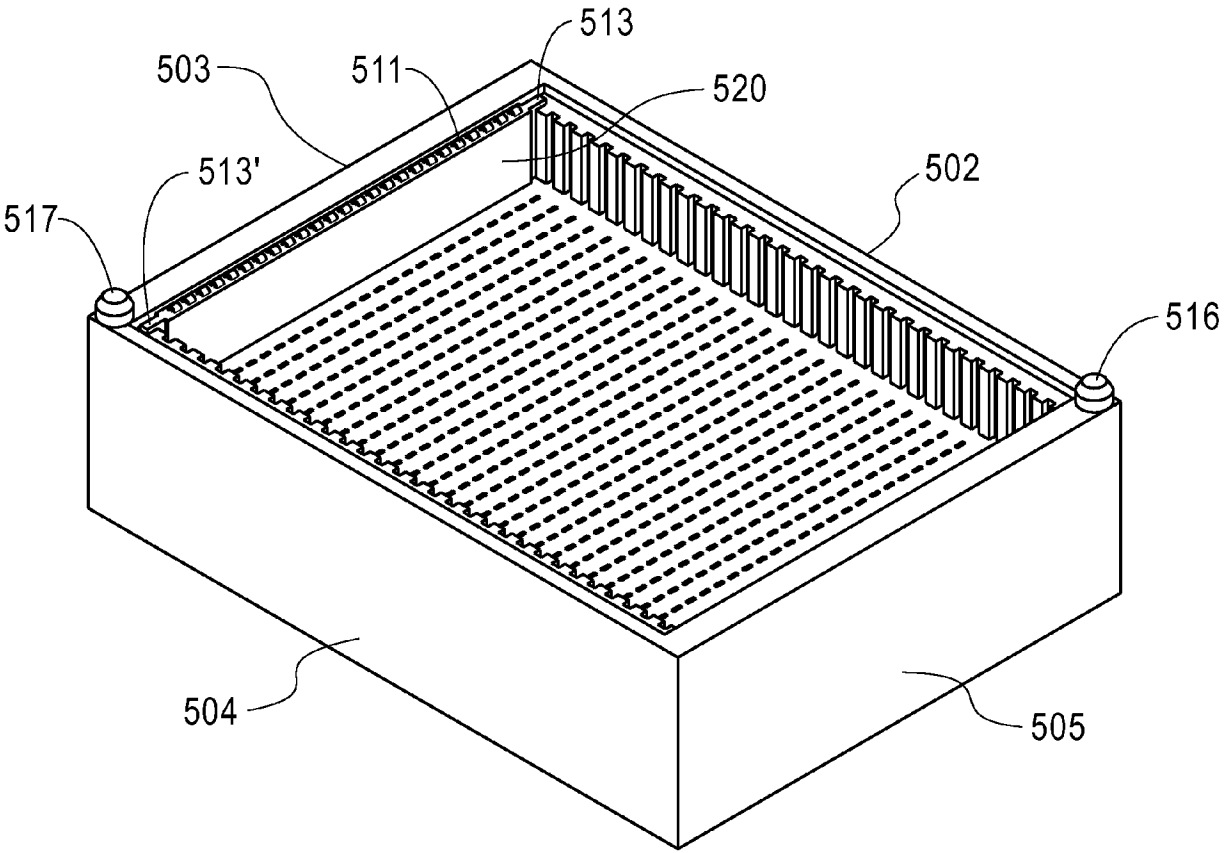
FIG. 25 is a view of the header assembly with the first pin assembly inserted therein, both as depicted in FIG. 22.

FIG. 25 is an isometric view of pin assembly 508 of FIG. 24A inserted in place in the aligned slots and openings in header-base 500.

Figure 26:
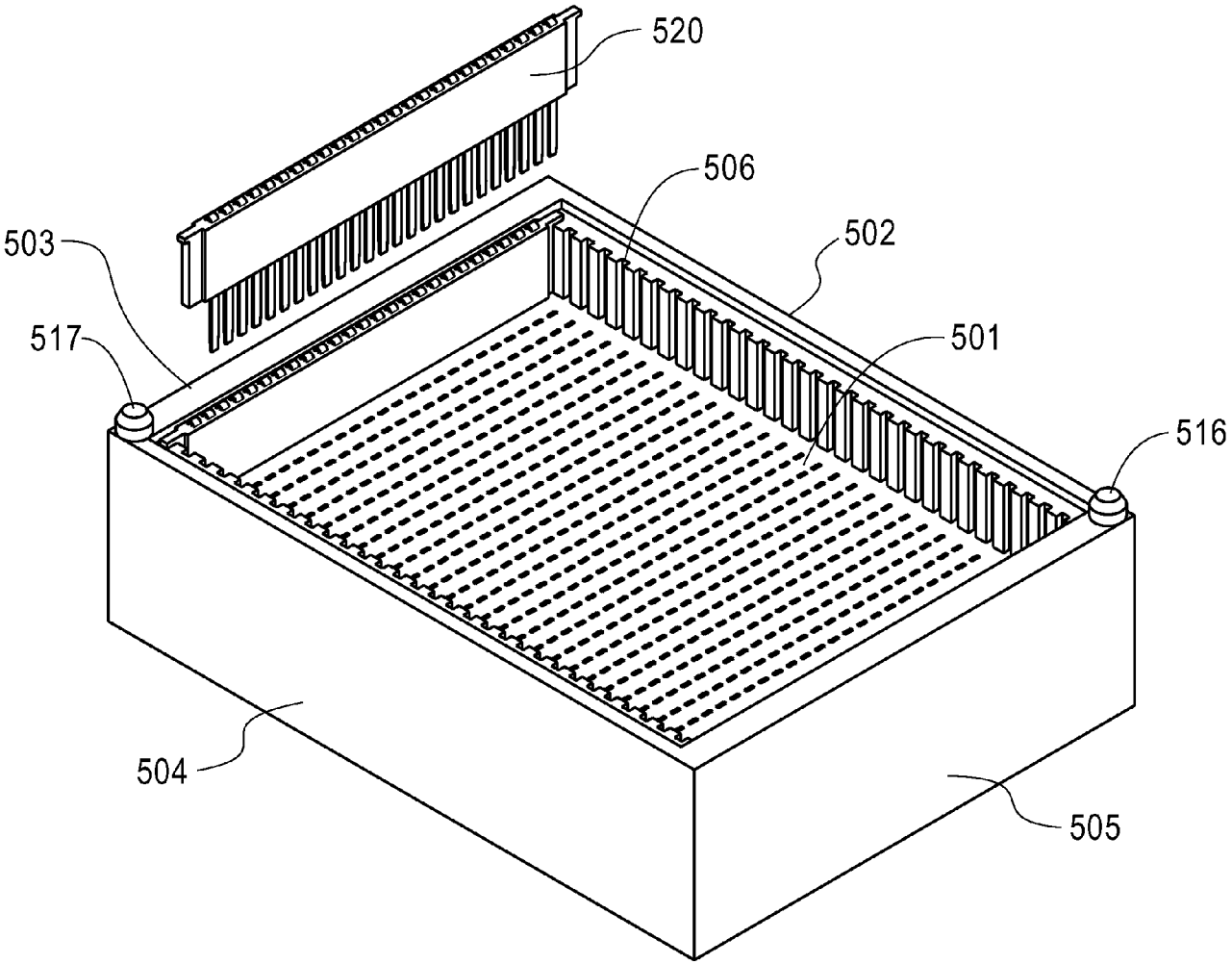
FIG. 26 is an exploded view of the second pin assembly aligned with the openings in the header assembly.

FIG. 26 is an exploded isometric view of the assembly depicted in FIG. 25 with a second pin assembly 520 aligned to be inserted into the grooves 506 and openings 501 provided.

Figure 27:
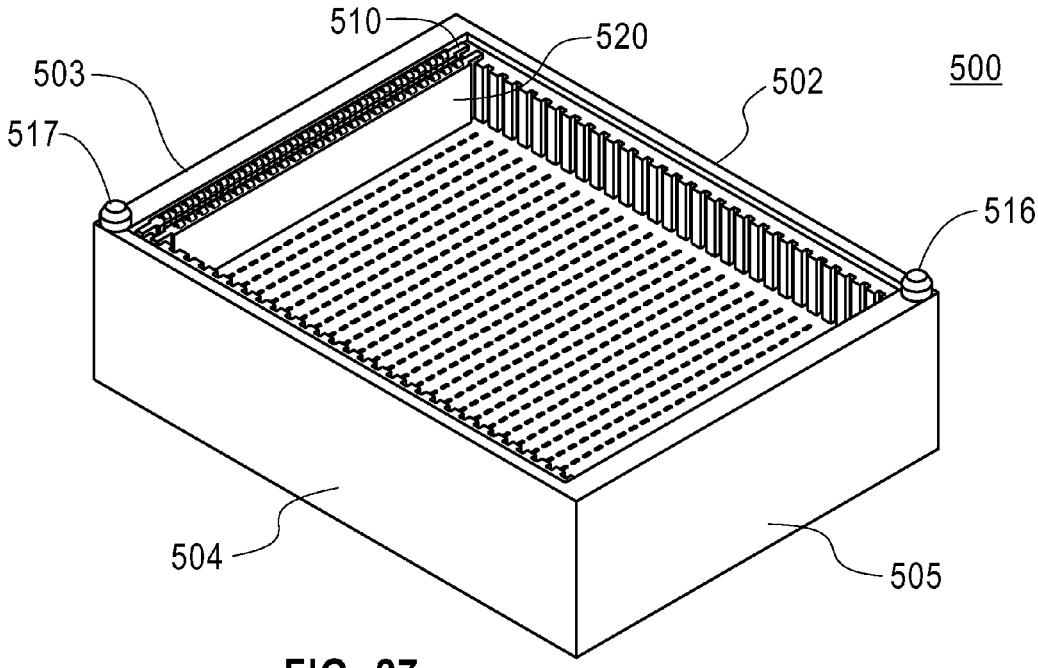
FIG. 27 is a view of the header assembly wherein the second pin assembly as depicted in FIG. 26 is inserted therein.

FIG. 27 is an isometric view of the header assembly 500 depicted in FIG. 26 with the second pin assembly 520 inserted in place.

Figure 28:
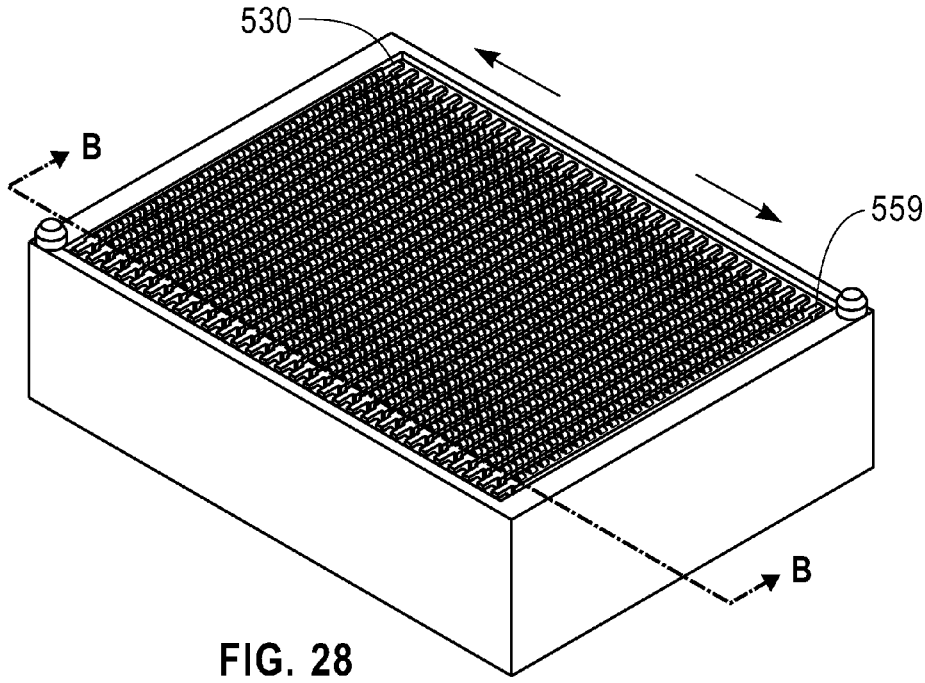
FIG. 28 is a view of the header assembly with a full complement of pin assemblies inserted therein.

FIG. 28 is an isometric view of the header assembly 500 having the full complement of thirty pin assemblies 530-559 inserted therein.

Figure 29:
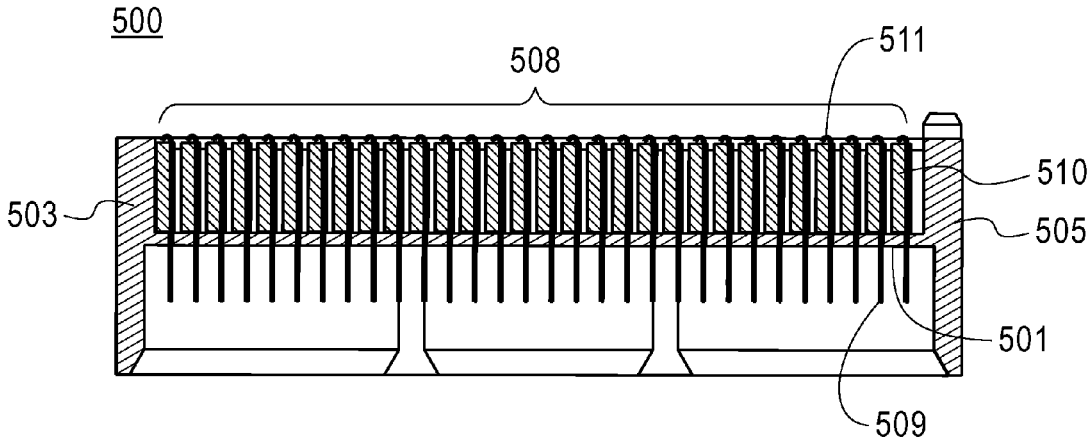
FIG. 29 is a cutaway view of the top portion of the header assembly along the line B-B as depicted in FIG. 28.

FIG. 29 is a cutaway isometric top view of the header assembly along the line B-B of FIG. 28. The cutaway view depicts rows of pin assemblies 508 between header assembly sides 503 and 505 along the cutaway edge of header assembly 500, the molded plastic frame 510 and conductors 509 extending through openings in base 501 and metal contacts 511.

Figure 30:
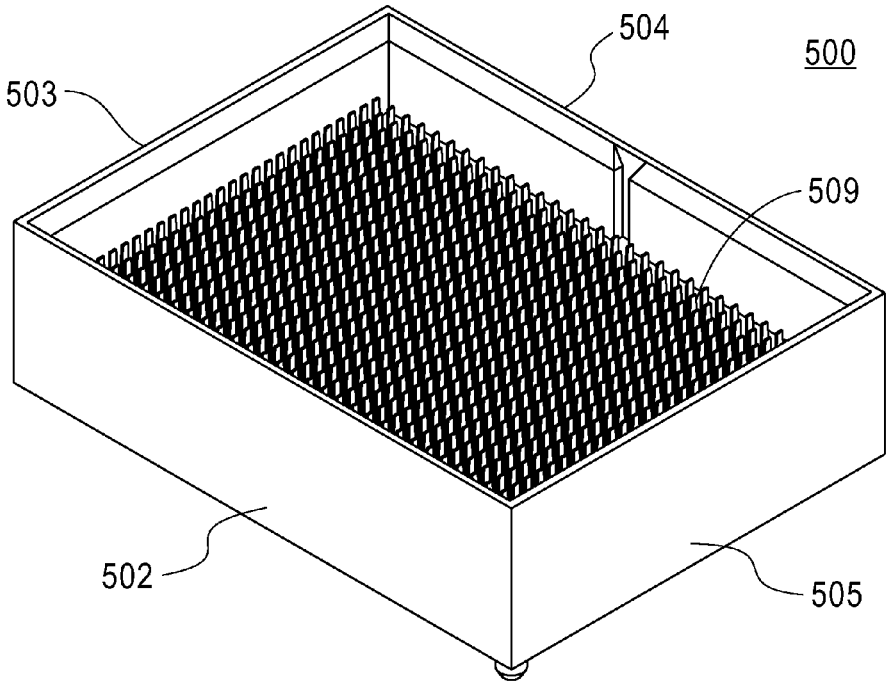
FIG. 30 is a view from the bottom of the header assembly.

FIG. 30 is an isometric bottom view of the header assembly 500 depicted in FIG. 28. The rows and columns within the confines of header assembly 500 are each filled with conductor 509 of the type depicted in FIG. 24B.

Figure 31:
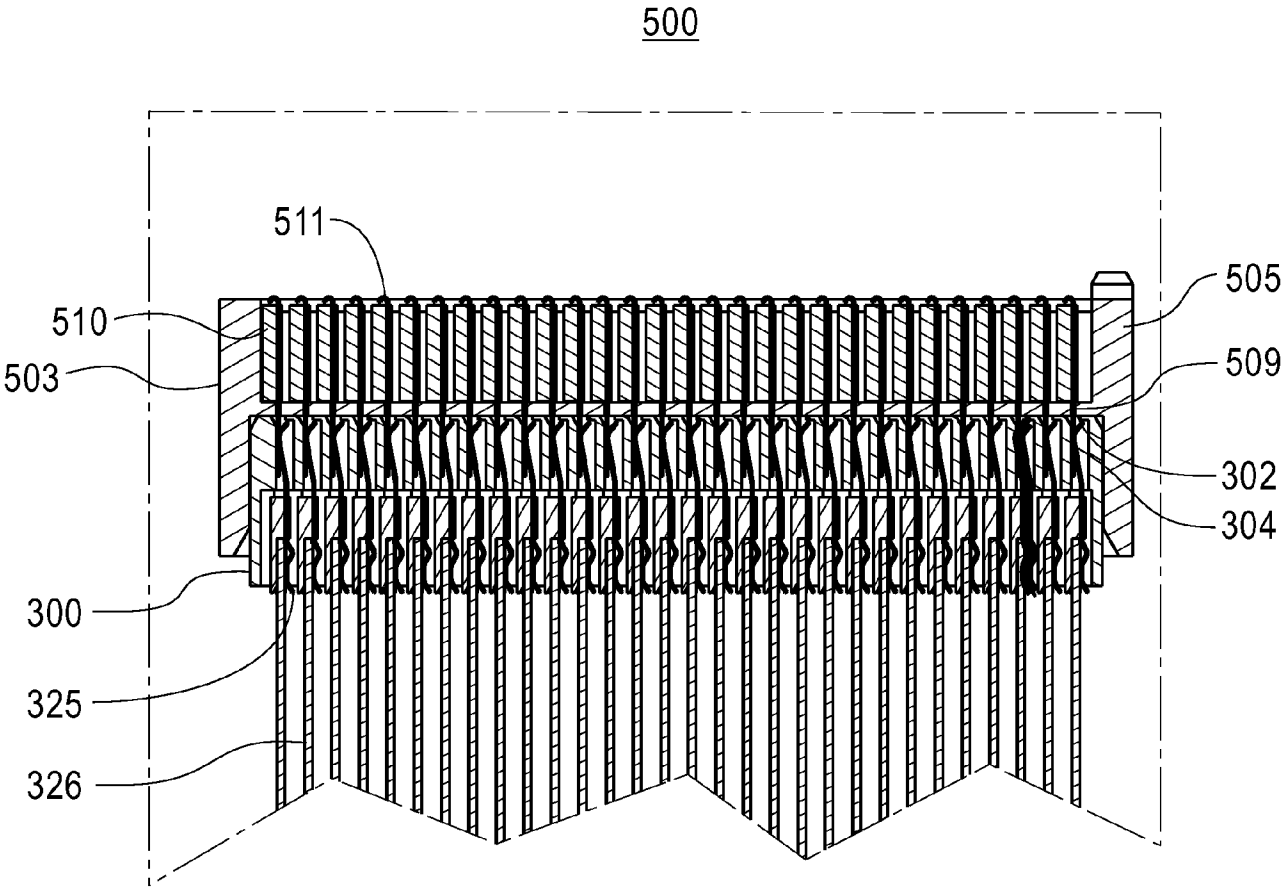
FIG. 31 is a cutaway view of the connected receptacle assembly and header assembly along the line B-B depicted in Figure.

FIG. 31 is a closeup side sectional view of the isometric view presented in FIG. 28 depicting the header assembly 500 of the present invention in contacting relationship with the top base receptacle assembly 300. Illustrated are 30 rows of pin assemblies each exposing top contacts 511, molded plastic frame 510, conductors 509 wherein each conductor 509 in header assembly 500 extends through an opening 302 in the top base element of receptacle assembly 300. When header assembly 500 is placed in contact with top base receptacle assembly 300, conductor 509 contacts finger 304 of the upper contact finger assembly in receptacle assembly 300. A lower contact finger 325 of upper receptacle contact finger assembly 300 contacts a circuit line (not shown but depicted in FIG. 5, elements 11, 12) on wafer circuit card 326 which in turn is connected to a lower receptacle contact finger assembly (not shown) and then on to contact a second circuit card (not shown).

Figure 32:
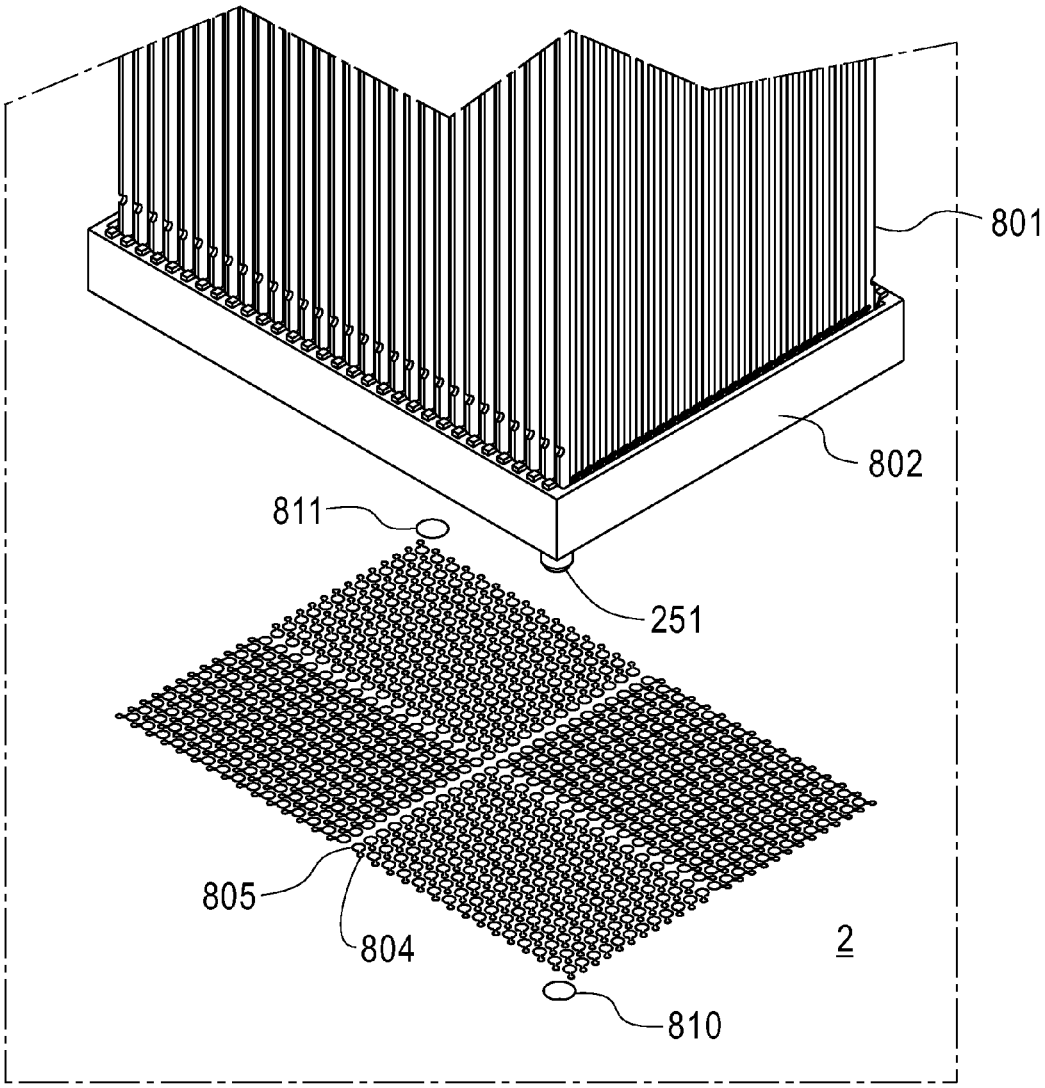
FIG. 32 is a closeup view of the alignment of the tall mezzanine connector with a circuit card.

FIG. 32 depicts a lower portion of a tall mezzanine connector 801 of the present invention as described hereinabove, with base receptacle element 802 suspended over the area of circuit card 2, with which it is placed in contact when in use. Circuit card 2 has rows and columns of solder pads 805 and underlying vias 804, wherein each of the solder pads 805 is in direct contact with a corresponding finger (not shown) in tall mezzanine connector 801. Alignment holes 810 and 811 in the circuit card receive corresponding alignment pins positioned on the base of the tall mezzanine connector of the type indicated in FIG. 21 at 250 and 251. This is to insure the tall mezzanine connector is located properly for the soldering process that connects wafer fingers (not shown) to the solder pads 805. If wafer contact fingers (not shown) were of the press-fit type, the alignment pins 250 and 251 plus alignment holes 810 and 811 would not be necessary.

Figure 33:
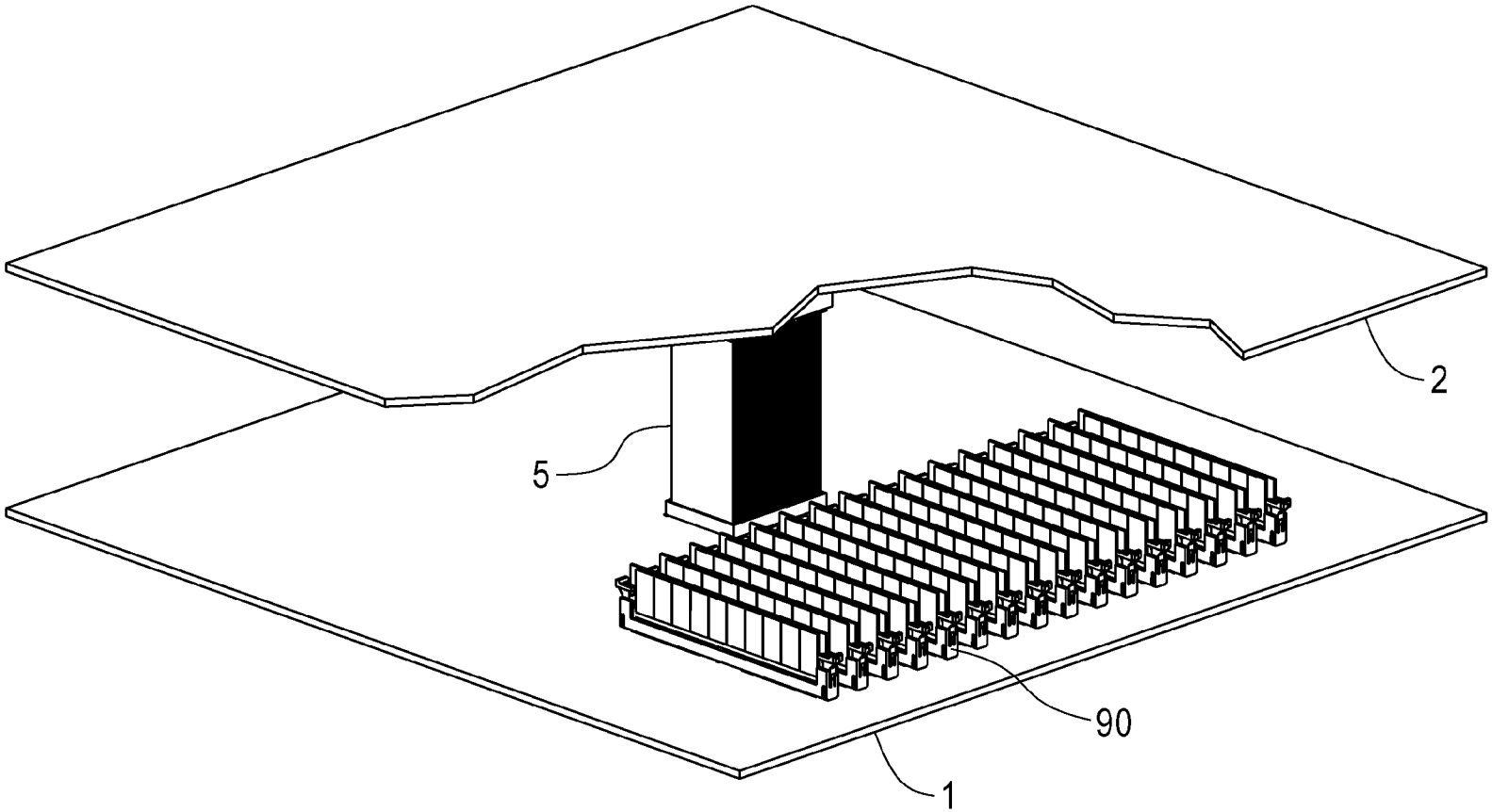
FIG. 33 depicts an embodiment of the spatial relationship of the mother cards, daughter cards and tall mezzanine connector of the present invention.

FIG. 33 depicts one embodiment of the present invention wherein mother cards 1 and 2 are connected by tall mezzanine connector 5 of the present invention as well as a plurality of daughter cards 90 connected to mother card 1.

The receptacle and header of the present invention can be adapted to be attached to circuit cards in such other ways as press fit pins and land grid array (LGA). The LGA can be electrically connected to the wafer printed circuit board (PCB) either by the use of a socket or by soldering directly to the board. The solder ball used as a contact in this event is the type adapted for a ball grid array socket.

Thus as has been described in detail above and depicted in the drawings, the present invention comprises several embodiments of a mezzanine connector comprising a header and a receptacle assembly.

The header has a header base and a plurality of pin assemblies. The header base is composed of a box-like structure having a level surface area, i.e. a base, connected to and within four sides, the four sides being perpendicular to the base level surface area and to each other thus forming an interior dimension, and the level surface area has a plurality of openings therethrough.

Each pin assembly has a support frame having metal contacts along the top of the support frame and fingerlike conductors along the bottom of the support frame. Each contact on the top of the support frame is adapted to be connected to one of the plurality of openings which contains conductors in a first circuit card.

The receptacle assembly comprises a bottom base, at least one wafer assembly and a top base. The top base of the receptacle assembly is also a box-like structure having a level surface area connected to and within four sides, with the four sides being perpendicular to the level surface area and to each other. The perimeter of the top base is adapted to contact and fit snugly within the interior dimension of the header base.

The level surface area of said top base of the receptacle has a plurality of openings therethrough, wherein each opening is aligned with the openings in the header base when the top base of the receptacle is in contact with and within the header base.

Each contact of the fingerlike conductor of the pin assembly extends through aligned openings in the header base and the top receptacle base.

The wafer assembly is a flexible printed circuit card, an upper receptacle contact finger assembly and a an lower receptacle contact finger assembly;

The upper receptacle contact finger assembly consists of a support frame securing wafer circuit card fingers and receptacle contact fingers. The receptacle contact fingers extend in a direction diametrically opposite to that of the wafer circuit card fingers.

The lower receptacle contact finger assembly consists of a support frame securing receptacle contact fingers and wafer circuit card fingers. The wafer circuit card fingers extend in a direction diametrically opposite to that of said receptacle contact fingers;

The flexible printed circuit card has a first edge and a second edge and a front surface and a back surface. The front surface of the printed circuit card has signal lines and ground lines, with the back surface of same having a ground plane.

The signal lines and said ground lines extend the distance of said circuit card from said first edge to said second edge, preferably the edges being top to bottom, or bottom to side.

In either embodiment, signal lines and ground lines at the first edge are in contact with wafer card fingers in the upper receptacle contact finger assembly, and the receptacle contact fingers being in contact with the fingerlike conductors of the pin assembly in the header base.

The signal lines and the ground lines at the second edge of the circuit card are in contact with the wafer circuit card fingers in the lower receptacle contact finger assembly.

The bottom base of the receptacle assembly, similar to the top base of the receptacle assembly consists of a box-like structure having a level surface area connected to and within four sides, the four sides being perpendicular to the level surface area and to each other.

The level surface area of the bottom base has a plurality of openings therethrough. The metal contacts extend through these openings in the bottom base to contact conductor sites in a second circuit card. Thus, connections are made from a first circuit card to a second circuit card by means of the mezzanine connector invention.

As noted, the present invention can also utilize a connector that has the connector wafer circuit card 600 elements positioned 90 degrees to each other.

Figure 34:
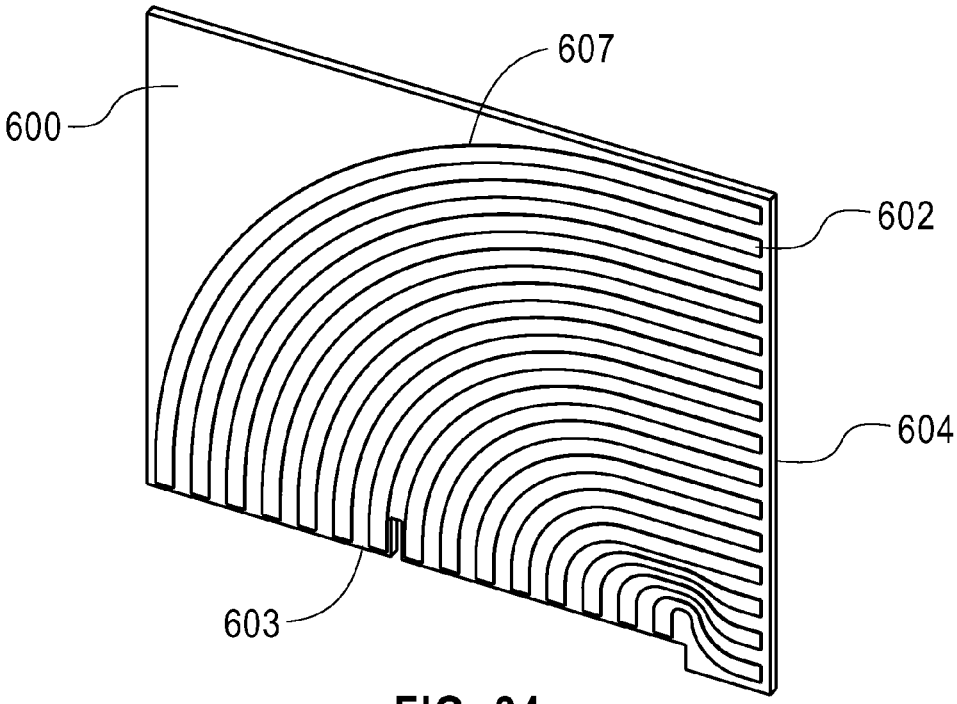
FIG. 34 is an oblique view of a wafer circuit card for use in a 90 degree connector.

FIG. 34 depicts a front oblique view of a wafer circuit card 600 for use in another embodiment of the invention, i.e., a 90 degree connector. Wafer circuit card 600 has circuit lines, of the type designated at 602, that extend radially from a bottom 603 of wafer circuit card 600 to side 604 of connector wafer circuit card 600. Wafer circuit card 600 depicted in FIG. 34 operates in the same manner as the vertical connector depicted in FIG. 5.

Figure 35:
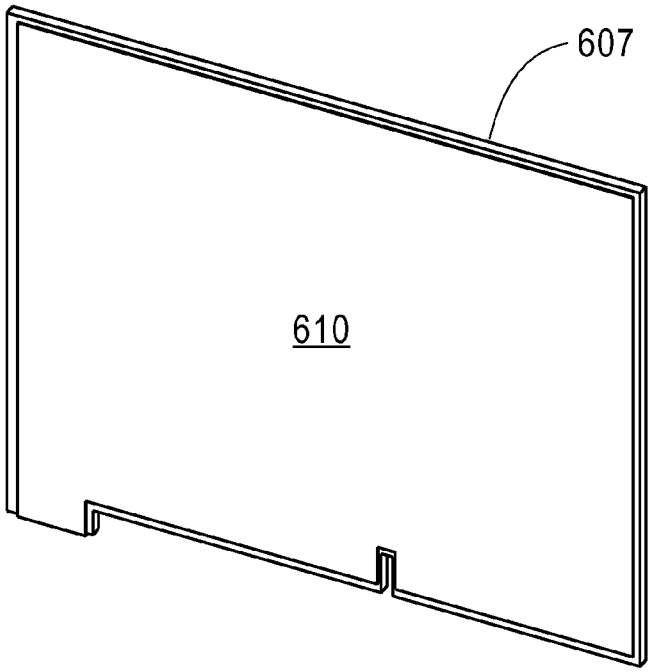
FIG. 35 is an oblique view of the back of a wafer circuit card as depicted in FIG. 34.

FIG. 35 is an oblique view of the back 610 of wafer circuit card 600 for use in a 90 degree connector as depicted in FIG. 34. This view shows a ground plane 610 connected to the front ground lines by vias (both not shown).

Figure 36:
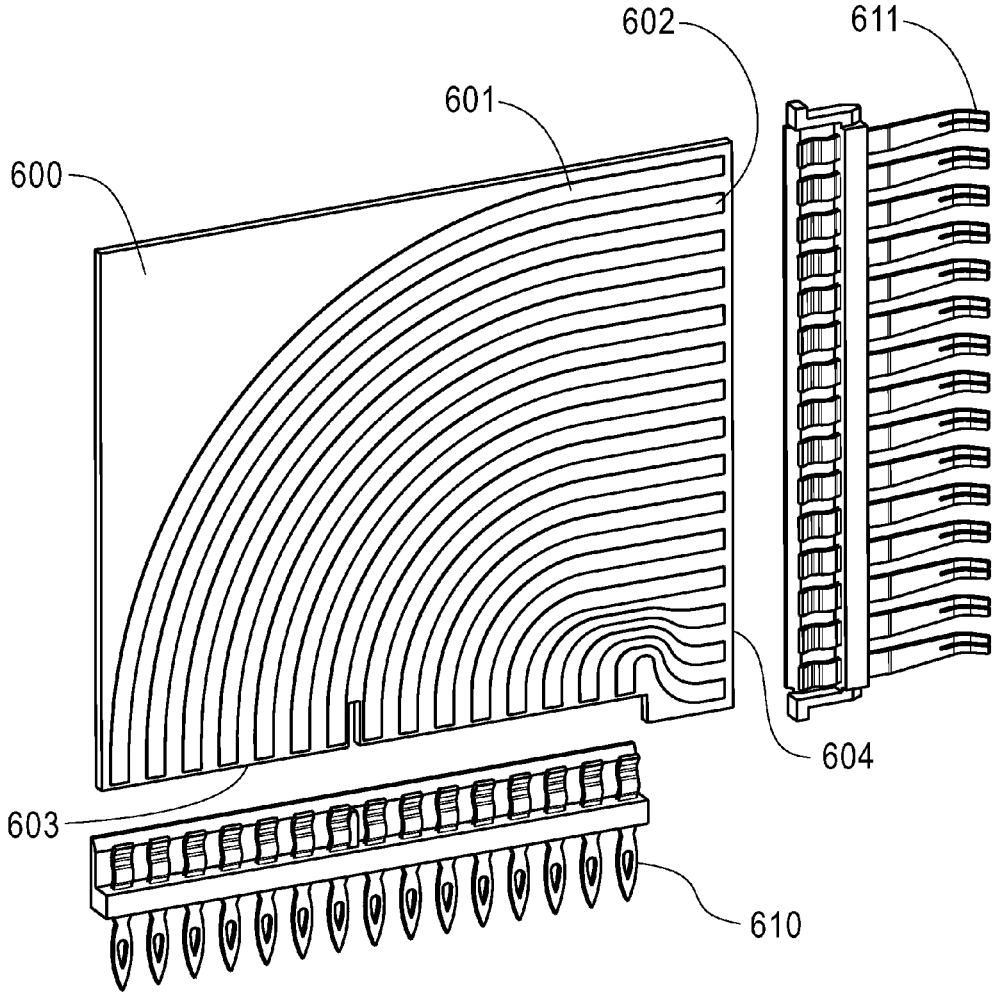
FIG. 36 is an oblique front exploded view of a wafer circuit card showing finger assemblies at the edges of the wafer circuit card.

FIG. 36 is an oblique front exploded view of the 90 degree wafer assembly showing finger assemblies at the edges of the wafer circuit card. Wafer circuit card 600 has a plurality of circuit lines 601, 602, etc., e.g., copper, on the order of 0.05 mm in thickness, which extend radially from a bottom 603 of wafer circuit card 600 to side 604 of connector wafer circuit card 600. At base 603 of wafer circuit card 600, there is a row of lower assembly contact fingers 610, (in this case, "press-fit type fingers," each of which is adapted and positioned to contact a circuit line of the type shown at 601, 602, etc. At side 604 of wafer circuit card 600, there is a column of receptacle contact fingers 611, each of which is adapted and positioned to contact a circuit line in the same relative position as the circuit line emanating from the base of wafer circuit card 600.

FIG. 37 is an oblique front view of a fully assembled 90 degree wafer assembly having the elements depicted in FIG. 36. Finger assembly elements 610 and 611 depicted in FIG. 36 are in contact with circuit lines 601, 602, etc. respectively.

Figure 38:
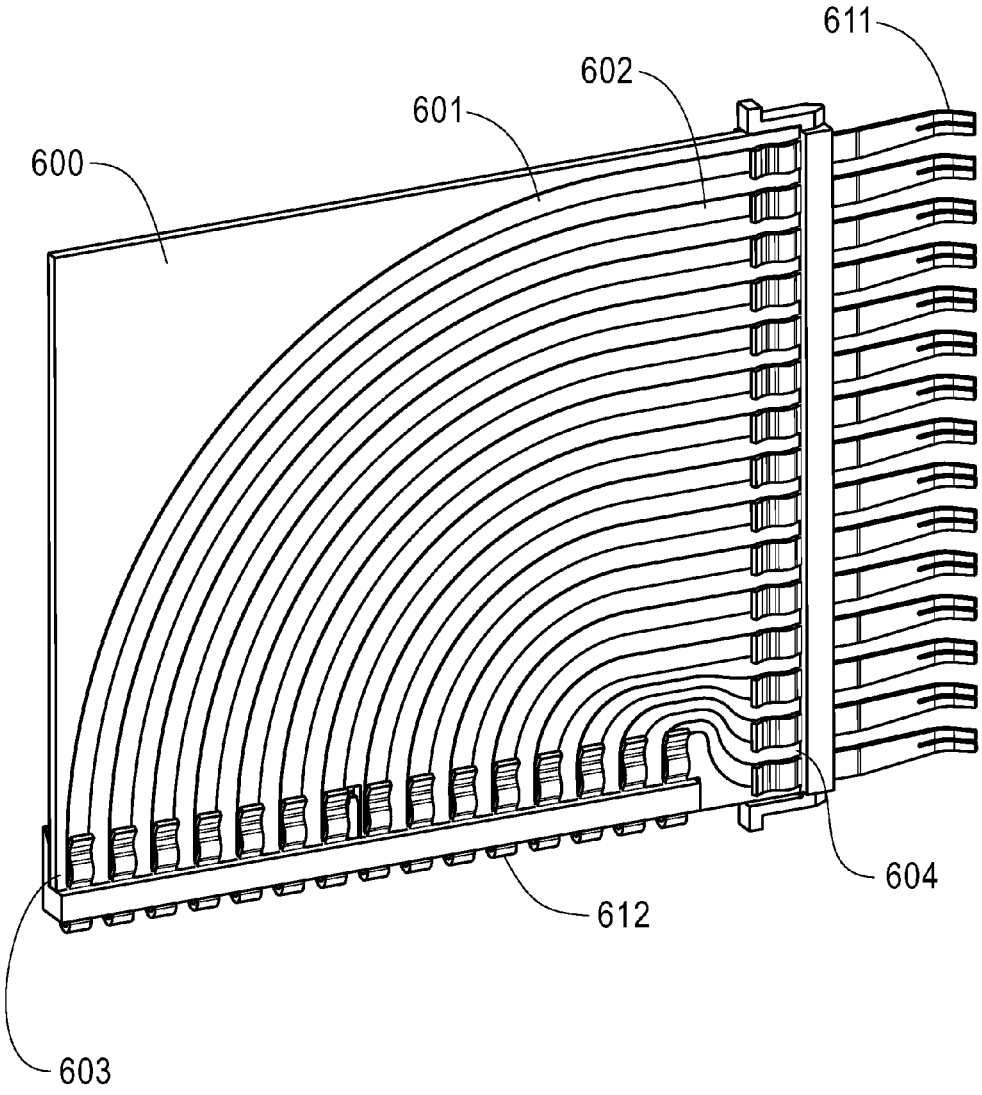
FIG. 38 is an oblique front view of a wafer assembly showing alternate contact means.

FIG. 38 depicts a fully assembled circuit card as depicted in FIG. 37 with the exception that the row of finger assembly contacts 612 at the base 604 of circuit card 600 comprise contacts 612 that can be soldered to another circuit card.

Figure 39:
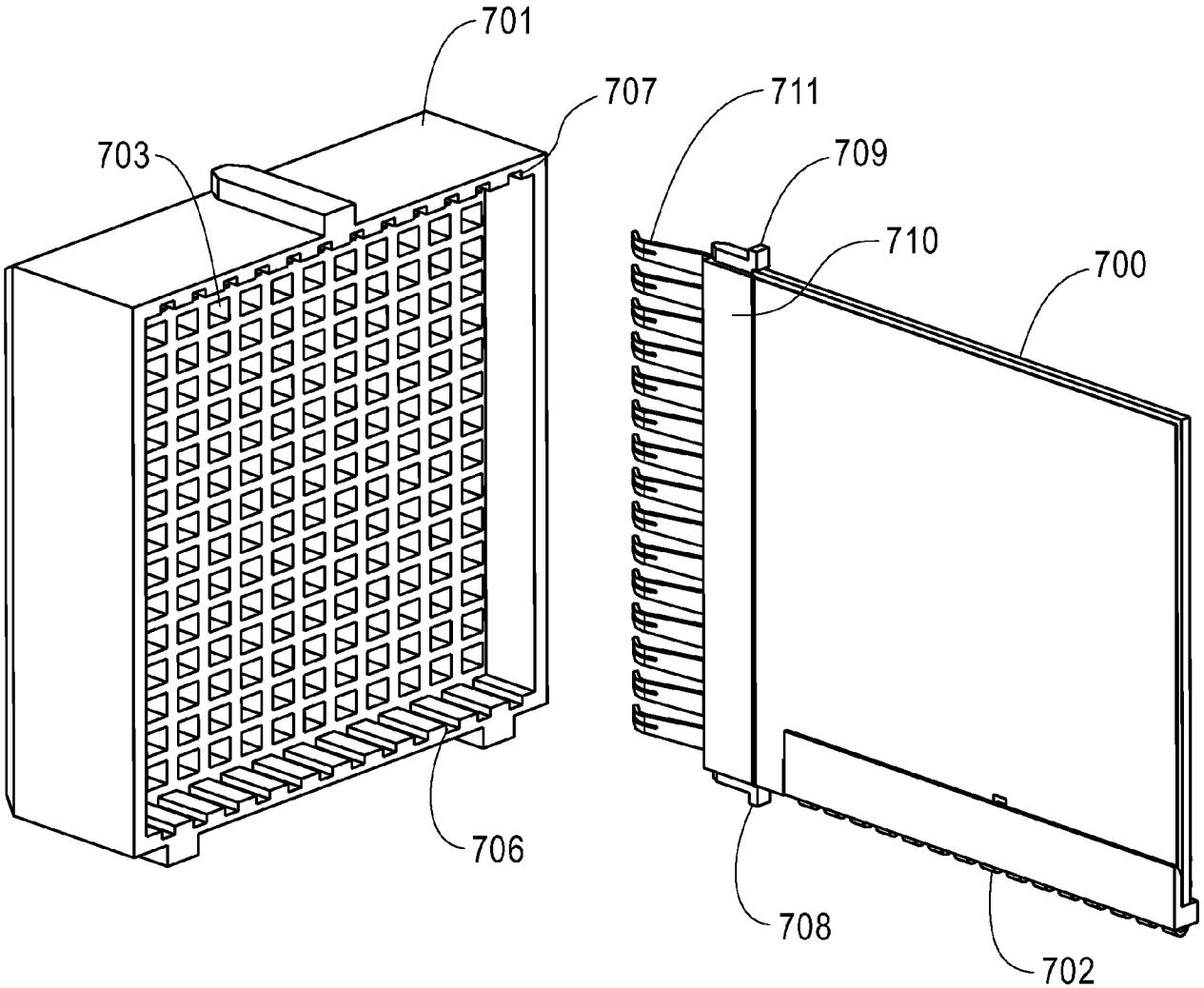
FIG. 39 is an oblique front exploded view of one wafer assembly and a receptacle housing.

FIG. 39 depicts an oblique exploded view of assembled wafer assembly 700 depicted in FIG. 38 and a receptacle housing 701 which secures the assembled wafer assembly when in use. Wafer assembly is positioned on a support tray 706. The wafer assembly is secured vertically in this instance by a strip 710 which has slot guides 708, 709 that fit within grooves 706, 707 respectively when the wafer assembly is inserted into receptacle housing 701. The row of pin or solder contacts 702 at the base of the fully assembled 90 degree connector circuit card is adapted to contact a first circuit card (not shown). Each of the fingers such as is depicted at 711, when in use, will extend respectively through each of the openings of the type depicted at 703 in receptacle housing 701. Fingers 711 are adapted to contact a second circuit card (not shown) which is positioned normal to the first circuit card (not shown).

Figure 40:
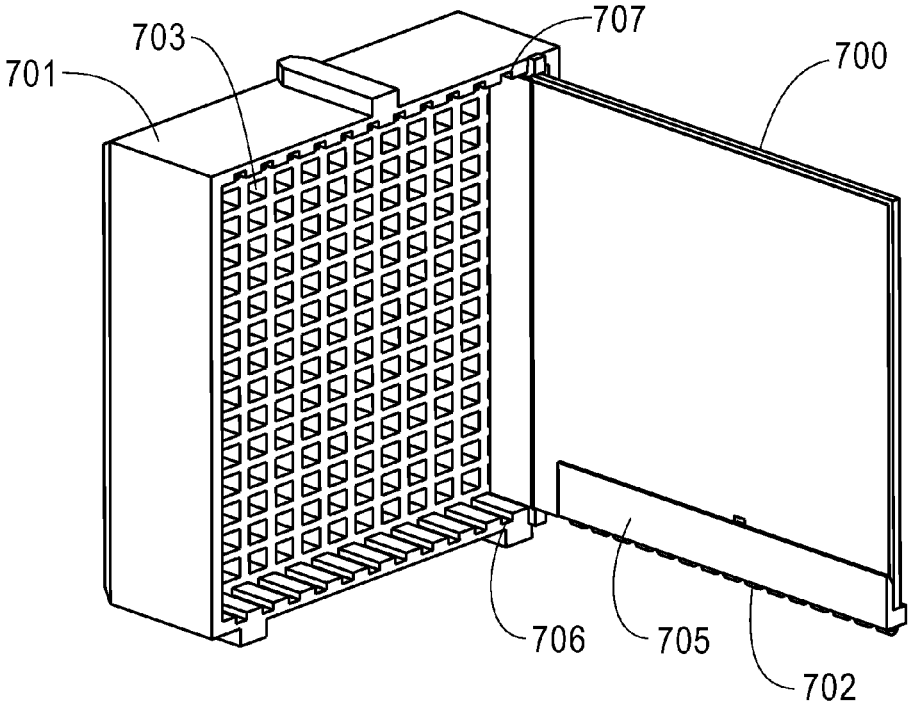
FIG. 40 is an oblique front view of one wafer assembly inserted into the receptacle housing in which it is positioned in use.

FIG. 40 depicts an oblique view of a single assembled wafer assembly 700 depicted in FIG. 39 fully inserted into receptacle housing 701. The row of pin or solder contacts 702 at the base of the fully assembled 90 degree connector circuit card is adapted to contact a first circuit card (not shown). The fingers (not shown) extending through each of the openings of the type depicted at 703 in receptacle housing 701 are adapted to contact a second circuit card (not shown) which is positioned normal to the first circuit card (not shown).

Figure 41:
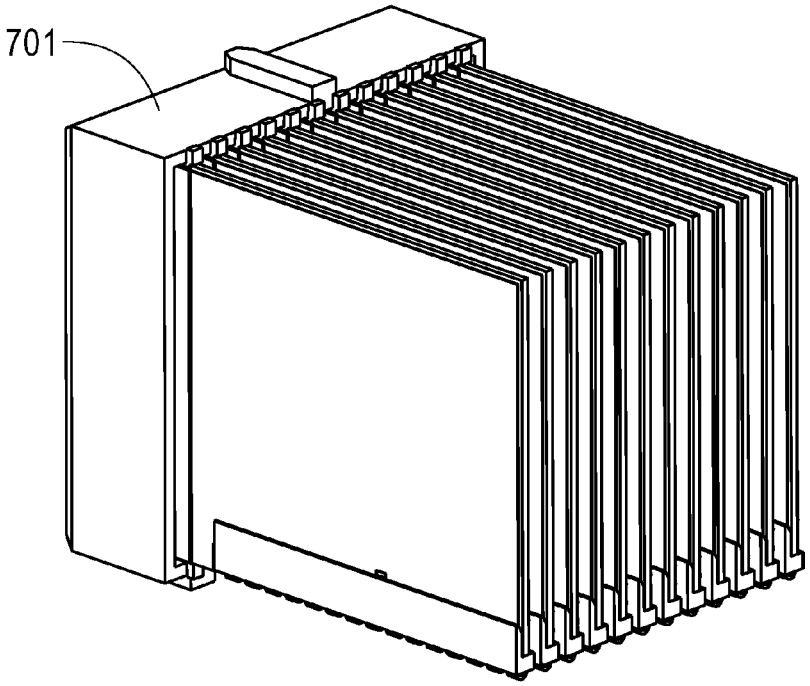
FIG. 41 is an oblique front view of a full complement of wafer assemblies in place in the receptacle housing.

FIG. 41 is a view of the receptacle housing 701 and a full complement of wafer assemblies of the type as depicted as 700 in FIG. 41, wherein the fingers (not shown) extending from each of the full complement of assembled circuit cards are inserted place in receptacle housing 701. The fingers or pins (or solder elements) 702 at the base of the 90 degree connector circuit card complete the circuit between a first circuit card and a second circuit card positioned normal to each other (both not shown).

Figure 42:
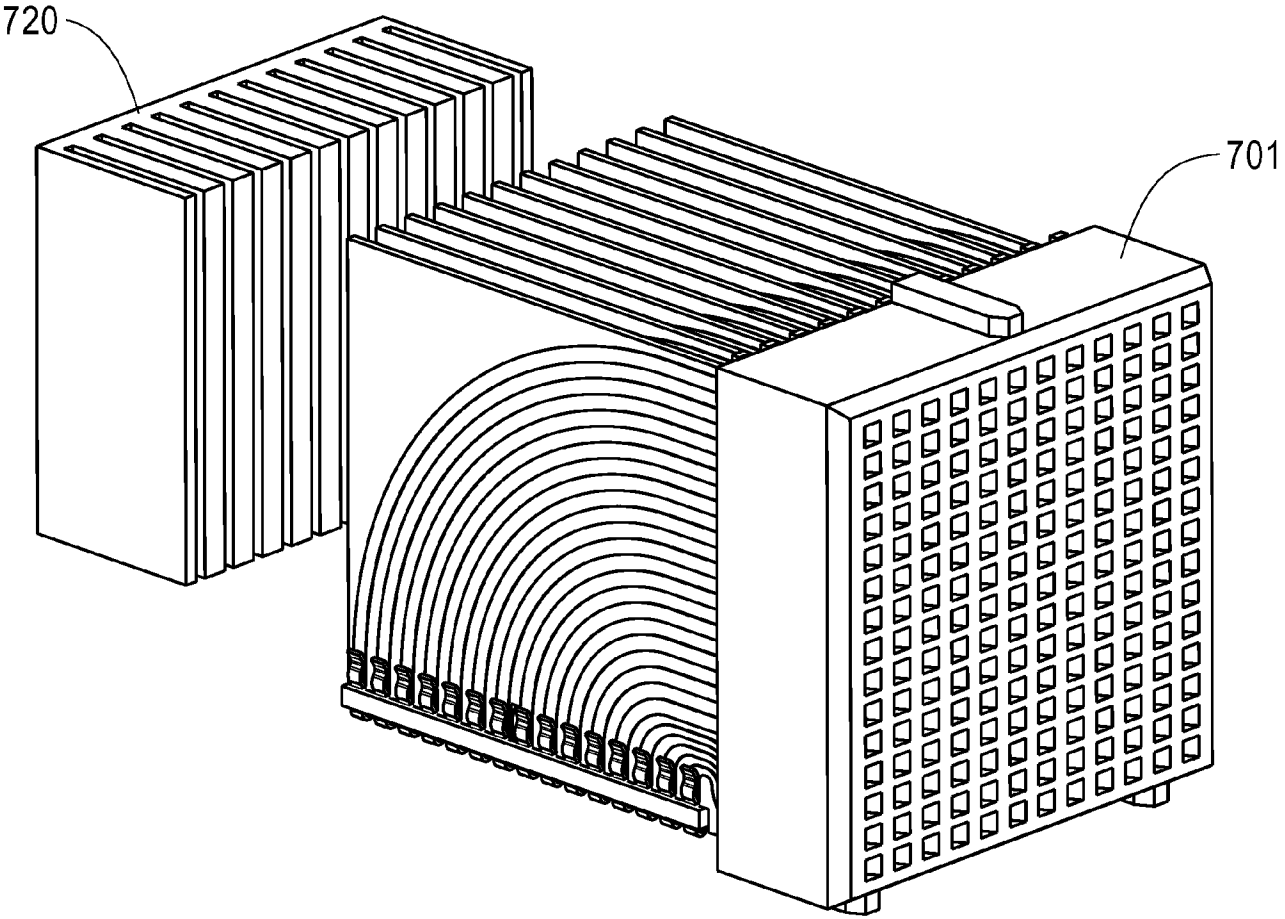
FIG. 42 is an oblique front view of a rear stabilizer to secure the back ends of wafer assemblies when in place in the receptacle.

FIG. 42 depicts an oblique reverse view of the assembly depicted in FIG. 41 showing receptacle housing 701 with a full complement of wafers and receptacle as depicted and described in FIG. 39 in combination with a rear stabilizer 720 which secures the back ends of the wafer assemblies when in place in the receptacle. Stabilizer 720 is employed to insure proper spacing of the 90 degree connector circuit cards with respect to one another.

Figure 43:
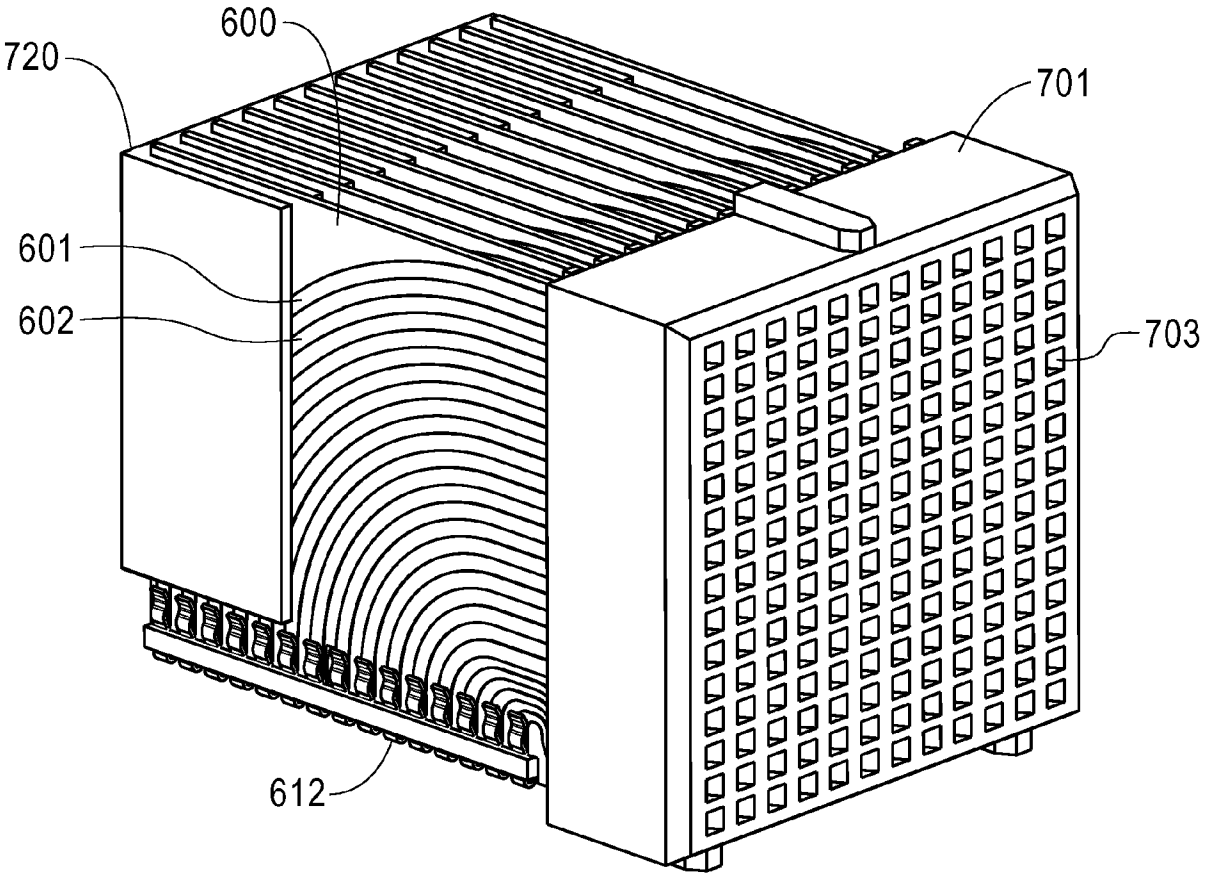
FIG. 43 is an oblique front view of the completed connector.

FIG. 43 is an oblique frontal view of the completed connector system showing the arrangement of the total system including receptacle housing 701 with openings of the type depicted at 703 to receive contact fingers (not shown), a plurality of 90 degree wafer assemblies 600, with a plurality of signal lines 601, 602 thereon, solder type fingers 612, and rear stabilizer 720.

Figure 44:
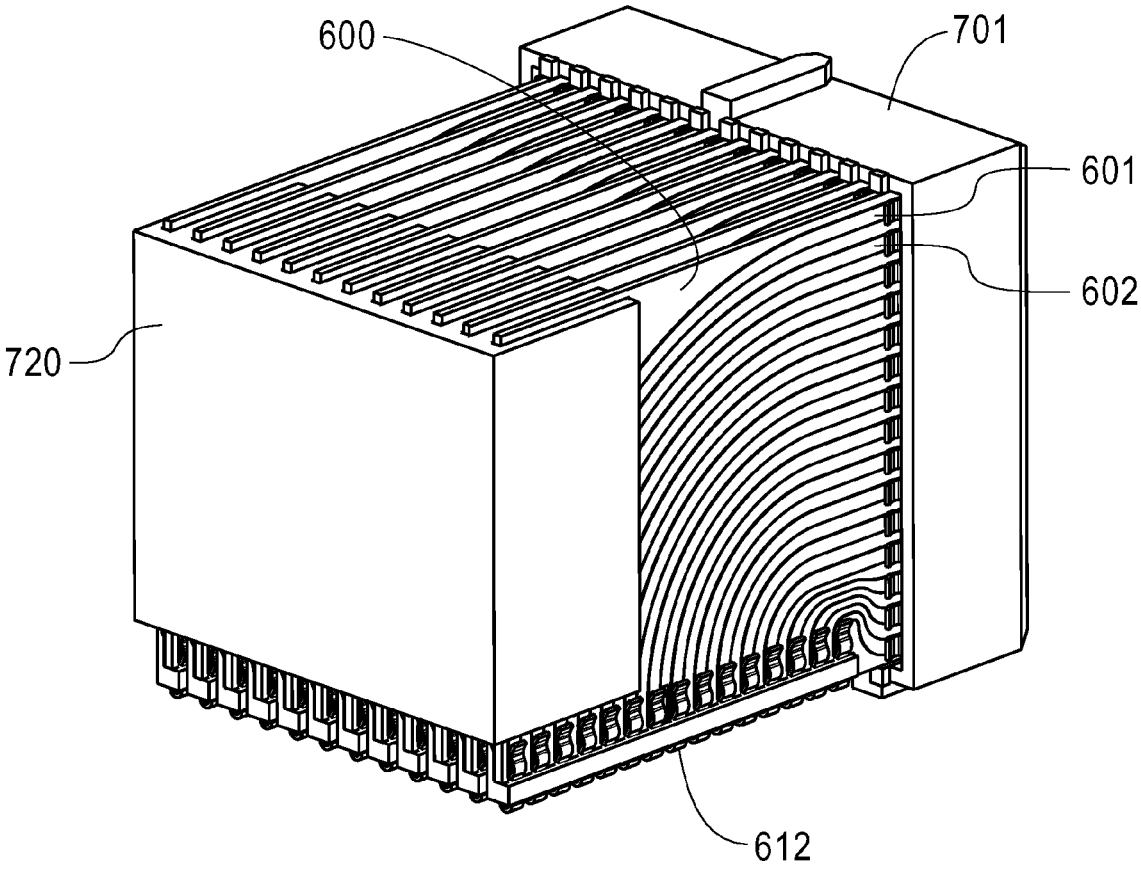
FIG. 44 is an oblique rear view of the completed connector.

FIG. 44 is a rear view of the completed system depicted in FIG. 43 showing from a different perspective the arrangement of the total system including receptacle housing 701 with openings to receive contact fingers (not shown), a plurality of 90 degree wafer assemblies 600, with a plurality of signal lines 601, 602 thereon, solder type fingers 612 and rear stabilizer 720.

The structure of the tall flexible mezzanine connector as described in the specification and drawings is configured in such a way that there is compliance in the connector that allows it to mate to another half of the connector when the two halves do not align as depicted in FIGS. 9 and 10. This compliance allows the connector to be taller because as distances between boards increase the amount of misalignment increases.

While all of the fundamental characteristics and features of the present apparatus of the disclosed invention have been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that any such substitutions, modifications, and variations may be made by those skilled in the art without departing from the spirit or scope of the invention. Consequently, all such modifications and variations are included within the scope of the invention as defined by the following claims.

What we claim and desire to protect by Letters Patent is:

1. A wafer assembly comprising means for connecting at least two electronic circuit boards, at any location along said circuit boards, said wafer assembly means for connecting comprising a header assembly comprising a header base containing a plurality of pin assemblies, said header assembly pin assemblies adapted to contact a first electronic circuit board;

a receptacle assembly, said receptacle assembly comprising a top base element, a bottom base element and a plurality of wafer assemblies, said top base element having contacts adapted to contact said pin assemblies in said header assembly, and said bottom base element having contacts adapted to contact pads on a second circuit board each said wafer assembly comprising a solid flexible printed circuit card connector substrate having edges defining a shape of said solid flexible connector substrate and having a thickness between about 0.1 mm and about 0.5 mm, and at least one conductive layer in said solid flexible connector substrate containing signal layers extending from a first edge of said solid flexible substrate to a second edge of said solid flexible substrate;

a return current path ground means in said solid flexible connector substrate for providing a constant impedance and effective shielding between said signal conductors;

means for contacting said signal layers to each of said two electronic circuit boards, which electronic circuit boards are in planes substantially parallel to each other, said wafer assembly means forming a tall, flexible mezzanine connector which provides sufficient freedom of movement to account for mechanical tolerances over large system boards while concurrently providing sufficiently high and varied mezzanine mounting height options that system boards can be connected while containing relatively high and large complexes of components.

2. The wafer assembly defined in claim 1 wherein said solid flexible printed circuit card connector substrate is a rectangular cuboid.

3. The wafer assembly defined in claim 2 wherein said rectangular cuboid has a front surface and a rear surface, and said edges comprise a top edge and a bottom edge, and side edges connecting said top edge to said bottom edge.

4. The wafer assembly defined in claim 3 wherein said signal layers in said rectangular cuboid extend from said top to said bottom of said rectangular cuboid and are in contact with said means for contacting said signal layers to each of said two electronic circuit boards.

5. The wafer assembly defined in claim 4 wherein said return current path ground means are provided by lines interspersed within the signals on the signal layers.

6. The wafer assembly defined in claim 4 wherein said return current path ground means is provided by planar lines in layers containing ground conductors.

7. The wafer assembly defined in claim 4 which comprises a return current path ground means on said front surface comprising a plurality of parallel signal lines and a plurality of parallel ground lines fixed to said front surface and extending lengthwise from said top edge to said bottom edge;

said rear surface comprising a ground plane which is connected to said parallel ground lines by vias;

means extending transversely across said top edge and said bottom edge of said wafer assembly for contacting each of said two electronic circuit boards.

8. The wafer assembly defined in claim 7 wherein said means extending transversely across said top edge of said wafer assembly for contacting each said electronic circuit board is selected from the group consisting of press fit pins, land grid array and fingers.

9. The wafer assembly defined in claim 7 wherein said means extending transversely across said bottom edge of said wafer assembly for contacting each said electronic circuit board is selected from the group consisting of press fit pins, land grid array, fingers or solder means.

10. The wafer assembly defined in claim 7 wherein said flexible wafer provides compliance by flexing along the X and Y axes when connected to a first circuit card and a second circuit card, both of which said first and said second circuit cards are not in vertical alignment.

11. The wafer assembly defined in claim 3 wherein said signal layers in said rectangular cuboid extend from said top or said bottom to one of said sides of said rectangular cuboid.

12. The wafer assembly defined in claim 11 which comprises a return current path ground means on said front surface comprising a plurality of parallel signal lines and a plurality of parallel ground lines fixed to said front surface and extending radially from said bottom edge to said side edge;

said rear surface comprising a ground plane which is connected to said parallel ground lines by vias; and means extending transversely across said top edge and said bottom edge of said wafer assembly for contacting each said electronic circuit board.

13. The wafer assembly defined in claim 12 wherein said means extending transversely across said bottom edge of said wafer assembly for contacting each said electronic circuit board is selected from the group consisting of press fit pins, land grid array fingers or solder means.

14. The wafer assembly defined in claim 12 wherein said means extending transversely across said side edge of said wafer assembly for contacting each said electronic circuit board is selected from the group consisting of press fit pins, land grid array and fingers.

15. A connector assembly comprising:

a header assembly comprising a header base containing a plurality of pin assemblies, said header assembly pin assemblies adapted to contact a first electronic circuit board;

a receptacle assembly comprising a receptacle top base element, a receptacle bottom base element, and at least one printed circuit card wafer, said printed circuit card wafer comprising:

a solid flexible connector substrate having edges defining a shape of said solid flexible connector substrate and having a thickness between about 0.1 mm and about 0.5 mm, and at least one conductive layer in said solid flexible connector substrate containing signal layers extending from a first edge of said solid flexible substrate to a second edge of said solid flexible substrate;

a return current path ground means in said solid flexible connector substrate for providing a constant impedance and effective shielding between said signal conductors;

means for contacting said signal layers to electronic circuit boards;

a receptacle top base element which secures a top of said printed circuit card wafer;

a receptacle bottom base element which secures a bottom of said printed circuit card wafer;

said means for contacting said signal layers to said electronic circuit boards extending through openings in said receptacle top base element and said receptacle bottom base element and adapted to make electrical contact between said first electronic circuit board and said second electronic circuit board respectively, said flexible wafer providing compliance by flexing along the X and Y axes when connected to a first circuit card and a second circuit card, said circuit cards not being in vertical alignment, said wafer assembly means forming a tall, flexible mezzanine connector which provides sufficient freedom of movement to account for mechanical tolerances over large system boards while concurrently providing sufficiently high and varied mezzanine mounting height options that system boards can be connected while containing relatively high and large complexes of components.

16. The connector assembly defined in claim 15 wherein said flexible wafer provides compliance by flexing along the X and Y axes when connected to a first circuit card and a second circuit card, said circuit cards not being in vertical alignment.

17. The connector assembly defined in claim 16 wherein said signal layers in said rectangular cuboid extend from said top to said bottom of said rectangular cuboid and are in contact with said means for contacting said signal layers to each of said two electronic circuit boards.

18. The connector assembly defined in claim 17 wherein said return current path ground means are provided by lines interspersed within the signals on the signal layers.

19. The connector assembly defined in claim 18 wherein said return current path ground means is provided by planar lines in layers containing ground conductors.

20. The connector assembly defined in claim 19 which comprises a return current path ground means on said front surface comprising a plurality of parallel signal lines and a plurality of parallel ground lines fixed to said front surface and extending lengthwise from said top edge to said bottom edge;

said rear surface comprising a ground plane which is connected to said parallel ground lines by vias;

means extending transversely across said top edge and said bottom edge of said wafer assembly for contacting each said electronic circuit board.

21. The connector assembly defined in claim 20 wherein said means extending transversely across said top edge of said wafer assembly for contacting each said electronic circuit board is selected from the group consisting of press fit pins, land grid array and fingers.

22. The connector assembly defined in claim 20 wherein said means extending transversely across said bottom edge of said wafer assembly for contacting each said electronic circuit board is selected from the group consisting of press fit pins, land grid array, fingers or solder means.

23. A mezzanine connector for parallel-mounted cards comprising:

a header assembly positioned atop and in electrical contact with a receptacle assembly;

said receptacle assembly comprising a plurality of flexible printed circuit card components, each said printed circuit card being a rectangular cuboid having a top, a bottom and two sides connecting said top and said bottom, said circuit card having a thickness between about 0.1 mm and about 0.5 mm, and having signal lines and ground lines in parallel relationship extending from said top of said wafer circuit card to said bottom of said circuit card, said signal line and ground line optionally extending vertically from said top to said bottom thereof, or alternatively said cuboid is a 90 degree connector circuit card wherein said signal lines and said ground lines extend radially from said bottom to said side thereof;

an upper receptacle contact finger assembly pivotally attached to said top of said printed circuit card having a plurality of conducting fingers in contact with said signal lines;

a lower receptacle contact finger assembly pivotally attached to said bottom of said printed circuit card having a plurality of conducting fingers in contact with said signal lines;

a receptacle base comprising four interconnected sides supported by a base element having a plurality of rows and columns openings therethrough;

said wafer assembly with contact fingers being fixed into said receptacle base;

said header assembly comprising four interconnected sides supported by a base element having a plurality of rows and columns of openings therethrough;

a plurality of pin assemblies, each pin assembly having a frame which has a bottom and a top, a plurality of electrical contact elements on top of said frame, and a plurality of conductors extending from the bottom of said frame;

said pins and fingers being in vertical contact with each other to pass signals from first circuit card to a second circuit card when said mezzanine connector is in contact with said circuit cards, said mezzanine connector means forming a tall, flexible mezzanine connector which provides sufficient freedom of movement to account for mechanical tolerances over large system boards while concurrently providing sufficiently high and varied mezzanine mounting height options that system boards can be connected while containing relatively high and large complexes of components.

24. The wafer assembly defined in claim 4 wherein there is a plurality of said signal layers in said rectangular cuboid extending from said top to said bottom of said rectangular cuboid and each said signal layer is in contact with said means for contacting said signal layers to each of said two electronic circuit boards.

25. A tall mezzanine connector comprising a header and a receptacle assembly;

said header comprising a header base and a plurality of pin assemblies, said header base comprising a box-like structure having a level surface area connected to and within four sides, said four sides being perpendicular to said level surface area and to each other thus forming an interior dimension;

said level surface area having a plurality of openings therethrough;

each said pin assembly comprising a support frame having contacts along a top of said support frame and fingerlike conductors along a bottom of said support frame, each said contact on said top of said support frame adapted to connect to one of said plurality of openings to conductors in a first circuit card;

said receptacle assembly comprising a bottom base, at least one wafer assembly and a top base;

said top base of said receptacle assembly comprising a box-like structure having a level surface area connected to and within four sides, said four sides being perpendicular to said level surface area and to each other, said top base having a perimeter adapted to contact and fit within said interior dimension of said header base;

said level surface area of said top base having a plurality of openings therethrough each said opening aligned with said openings in said header base when said top base of said receptacle is in contact with and within said header base;

each said contact of said fingerlike conductor of said pin assembly extending through aligned openings in said header base and said top receptacle base;

said wafer assembly comprising a flexible wafer circuit card having a thickness between about 0.1 mm and about 0.5 mm and having, an upper receptacle contact finger assembly and a an lower receptacle contact finger assembly;

said upper receptacle contact finger assembly comprising a support frame securing wafer circuit card fingers and receptacle contact fingers which extending in a direction diametrically opposite to that of said wafer circuit card fingers;

said lower receptacle contact finger assembly comprising a support frame securing receptacle contact fingers and wafer circuit card fingers, said wafer circuit card fingers extending in a direction diametrically opposite to that of said receptacle contact fingers;

said flexible printed circuit card having a first edge and a second edge and a front surface and a back surface, said front surface of said flexible printed circuit card having signal lines and ground lines, said back surface having a ground plane;

said signal lines and said ground lines extending the distance of said circuit card from said first edge to said second edge;

said signal lines and said ground lines at said first edge of said flexible printed circuit card being in contact with said wafer circuit card fingers in said upper receptacle contact finger assembly, and said receptacle contact fingers being in contact with said fingerlike conductors of said pin assembly in said header base;

said signal lines and said ground lines at said second edge said flexible printed circuit card being in contact with said wafer circuit card fingers in said lower receptacle contact finger assembly;

said bottom base of said receptacle assembly comprising a box-like structure having a level surface area connected to and within four sides, said four sides being perpendicular to said level surface area and to each other;

said level surface area of said bottom base having a plurality of openings therethrough, and having metal contacts extending through said openings said bottom base to contact conductor sites in a second circuit card.

* * * * *